US010727613B2

(12) United States Patent
Kruzel et al.

(10) Patent No.: US 10,727,613 B2
(45) Date of Patent: Jul. 28, 2020

(54) INSULATION PIERCING CONNECTORS

(71) Applicant: Panduit Corp., Tinley Park, IL (US)

(72) Inventors: Mateusz Kruzel, Orland Park, IL (US); Rodney G. Rouleau, Manhattan, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/181,573

(22) Filed: Nov. 6, 2018

(65) Prior Publication Data

US 2019/0148844 A1 May 16, 2019

Related U.S. Application Data

(60) Provisional application No. 62/585,095, filed on Nov. 13, 2017.

(51) Int. Cl.

| | |
|---|---|
| ***H01R 4/26*** | (2006.01) |
| ***H01R 4/2407*** | (2018.01) |
| ***H01R 13/52*** | (2006.01) |
| ***H01R 4/2408*** | (2018.01) |
| ***H01R 13/66*** | (2006.01) |
| ***H01R 43/01*** | (2006.01) |
| *H01R 4/36* | (2006.01) |
| *H01R 4/44* | (2006.01) |

(52) U.S. Cl.

CPC ..... *H01R 4/2407* (2018.01); *H01R 4/2408* (2013.01); *H01R 13/521* (2013.01); *H01R 13/6683* (2013.01); *H01R 43/01* (2013.01); *H01R 4/36* (2013.01); *H01R 4/44* (2013.01)

(58) Field of Classification Search

CPC ..... H01R 4/2433; H01R 4/2408; H01R 13/5216; H01R 4/2425; H01R 4/363; H01R 11/288

USPC ..... 439/402, 411, 781, 271, 413, 521, 811, 439/892

See application file for complete search history.

(56) References Cited

U.S. PATENT DOCUMENTS

| | | | |
|---|---|---|---|
| 4,427,253 | A | 1/1984 | Smith et al. |
| 4,684,196 | A | 8/1987 | Smith et al. |
| 4,985,003 | A | 1/1991 | Francois et al. |
| 5,015,198 | A | 5/1991 | Delin |
| 5,041,012 | A | 8/1991 | Caprio |
| 5,944,463 | A | 8/1999 | Savage, Jr. |
| 6,106,323 | A | 8/2000 | Elisei et al. |

(Continued)

FOREIGN PATENT DOCUMENTS

| | | |
|---|---|---|
| AU | 609 599 B2 | 5/1991 |
| CN | 202 513 293 U | 10/2012 |

(Continued)

*Primary Examiner* — Phuong Chi Thi Nguyen

(74) *Attorney, Agent, or Firm* — Christopher S. Clancy; James H. Williams; Peter S. Lee

(57) ABSTRACT

Various implementations of insulation piercing connectors are disclosed. The insulation piercing connectors may be used to attach dual independent electrical connections to a power cable for voltage detection purposes. In some implementations, an insulation piercing connector may include a top half, a bottom half, and a blade seal positioned between the top half and the bottom half. A threaded fastener may engage threads in a hole in a post on the bottom half. The threaded fastener may be tightened to compress the insulation piercing connector around a power cable.

20 Claims, 40 Drawing Sheets

(56) References Cited

U.S. PATENT DOCUMENTS

| | | | | |
|---|---|---|---|---|
| 6,264,492 | B1 * | 7/2001 | LaLaouna ..... | H01R 4/2408<br>439/402 |
| 7,090,544 | B2 | 8/2006 | Campbell et al. | |
| 7,104,832 | B2 | 9/2006 | Campbell et al. | |
| 7,131,856 | B2 | 11/2006 | Hoisington et al. | |
| 8,025,508 | B2 | 9/2011 | Parker et al. | |
| 8,025,521 | B2 | 9/2011 | Diniz et al. | |
| 8,272,904 | B2 | 9/2012 | Copper | |
| 8,987,595 | B2 | 3/2015 | Bumgarner | |
| 9,287,673 | B2 | 3/2016 | Galla et al. | |
| 9,577,351 | B2 | 2/2017 | Martin | |
| 2012/0222718 | A1 | 9/2012 | Sweeney | |

FOREIGN PATENT DOCUMENTS

| | | | |
|---|---|---|---|
| CN | 204 720 567 | U | 10/2015 |
| CN | 106 099 424 | A | 11/2016 |
| EP | 1615296 | A1 | 1/2006 |
| FR | 2 800 922 | A1 | 5/2001 |
| SE | 417 146 | B | 2/1981 |
| WO | 2014152949 | A1 | 9/2014 |

* cited by examiner

INSULATION PIERCING CONNECTORS

CROSS REFERENCE TO RELATED APPLICATIONS

This application claims priority to U.S. Provisional Application No. 62/585,095, filed Nov. 13, 2017, the subject matter of which is hereby incorporated by reference in its entirety.

BACKGROUND

Insulation piercing connectors may be used to attach sensing conductors, such as voltage detection lines, to a power cable. Some voltage detection devices may use dual independent electrical connections to each phase of a power cable to perform voltage detection. Voltage detection devices are typically mounted inside of a control panel before a first termination. Mounting a voltage detection device within the control panel provides for limited access and space.

SUMMARY

The present invention provides for a voltage detection that utilizes two independent electrical connections to a power cable for voltage detection through an insulation piercing connector.

BRIEF DESCRIPTION OF THE DRAWINGS

The following detailed description references the drawings, wherein.

DETAILED DESCRIPTION

Figure 1:
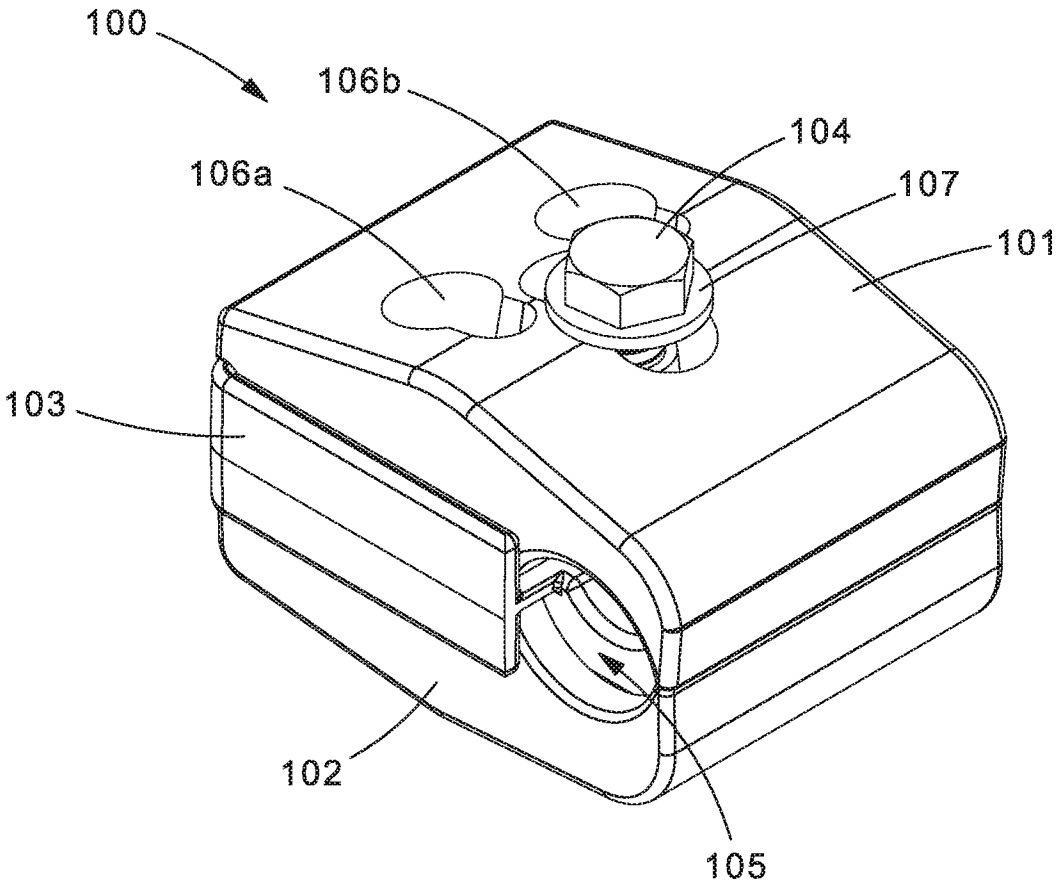
FIG. 1 is a trimetric view of an example insulation piercing connector.

The disclosed insulation piercing connector solves or improves upon one or more of the above noted and/or other problems and disadvantages with voltage detection devices and systems. The disclosed insulation piercing connector provides for a tandem system for sensing voltage in a compact configuration connectable in or out of a control panel. These and other objects, features, and advantages of the present disclosure will become apparent to those having ordinary skill in the art upon reading this disclosure.

Reference will now be made to the accompanying drawings. Wherever possible, the same reference numbers are used in the drawings and the following description to refer to the same or similar parts. It is to be expressly understood, however, that the drawings are for illustration and description purposes only. While several examples are described in this document, modifications, adaptations, and other implementations are possible. Accordingly, the following detailed description does not limit the disclosed examples. Instead, the proper scope of the disclosed examples may be defined by the appended claims.

Figure 2:
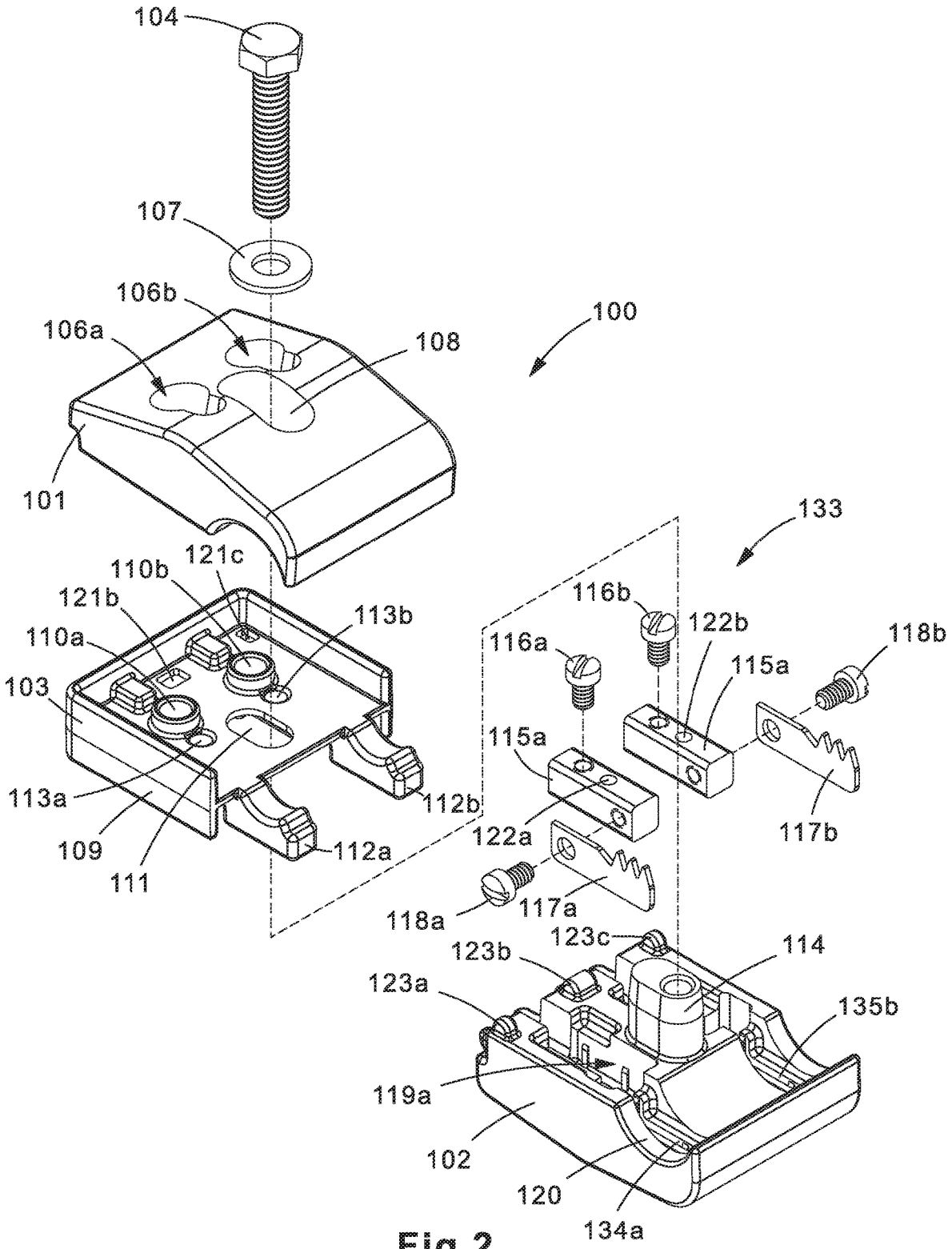
FIG. 2 is an exploded trimetric view of the example insulation piercing connector shown in FIG. 1.
Figure 3:
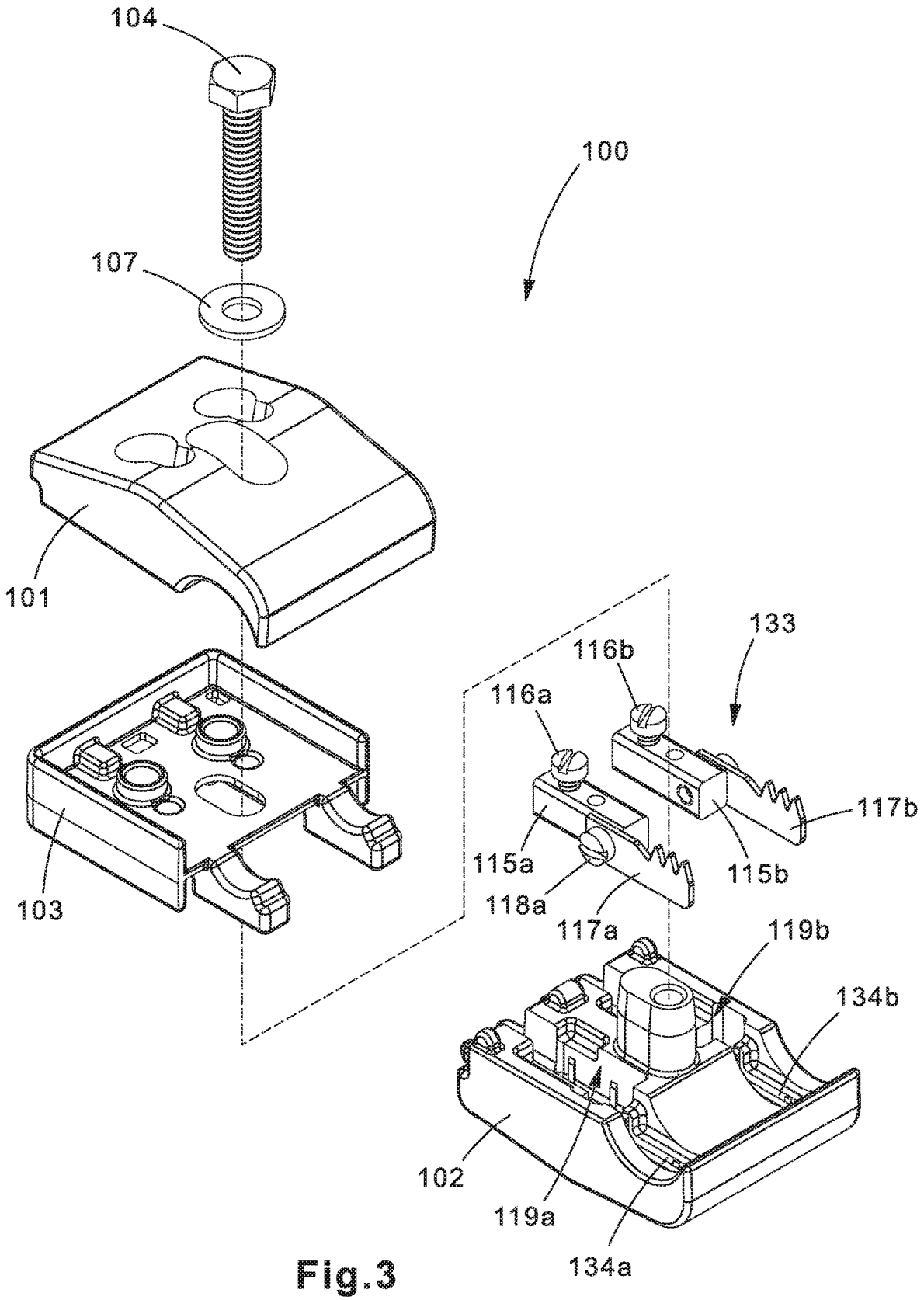
FIG. 3 is an exploded trimetric view of the example insulation piercing connector shown in FIG. 1.
Figure 4:
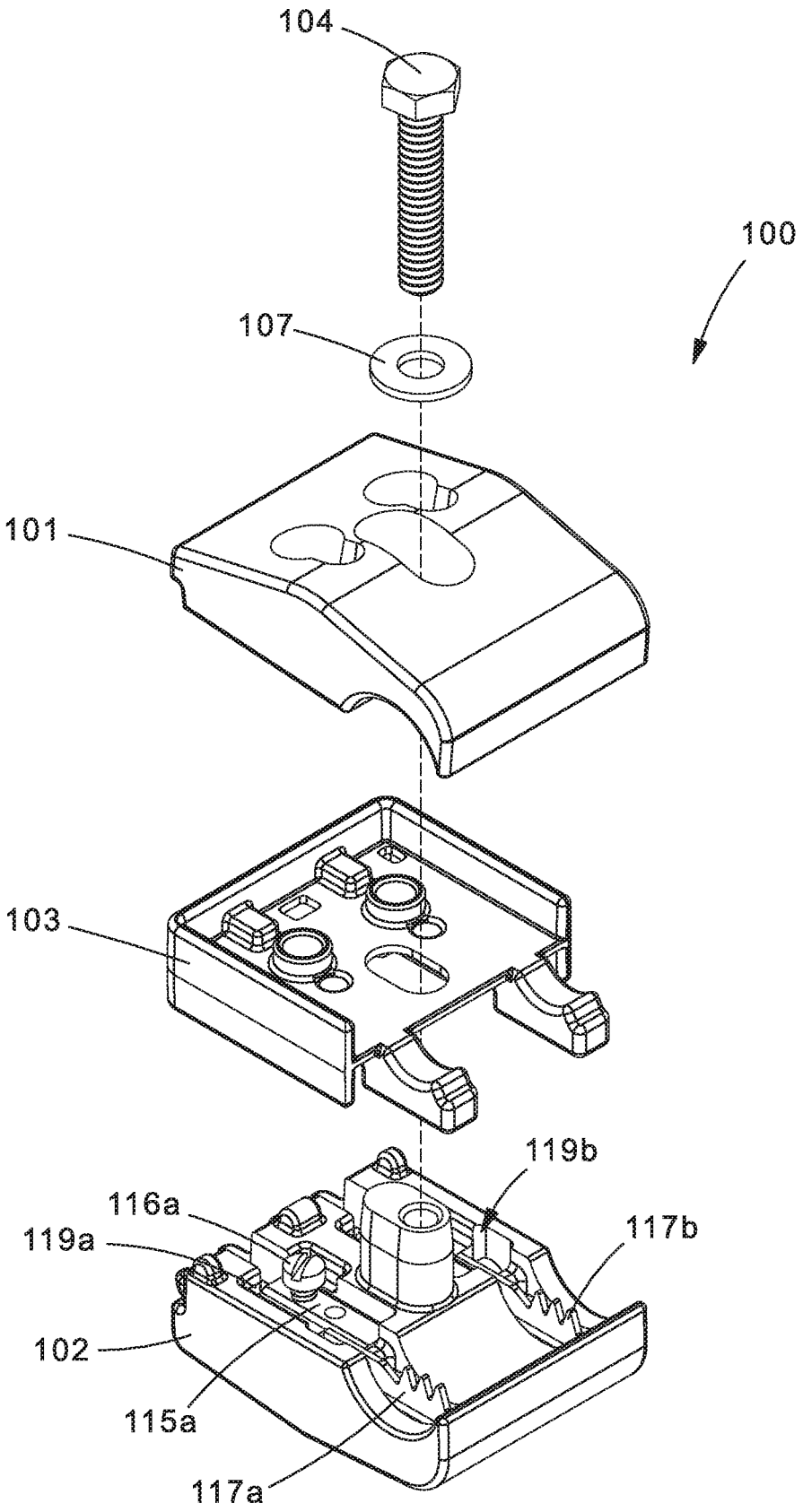
FIG. 4 is an exploded trimetric view of the example insulation piercing connector shown in FIG. 1.
Figure 5:
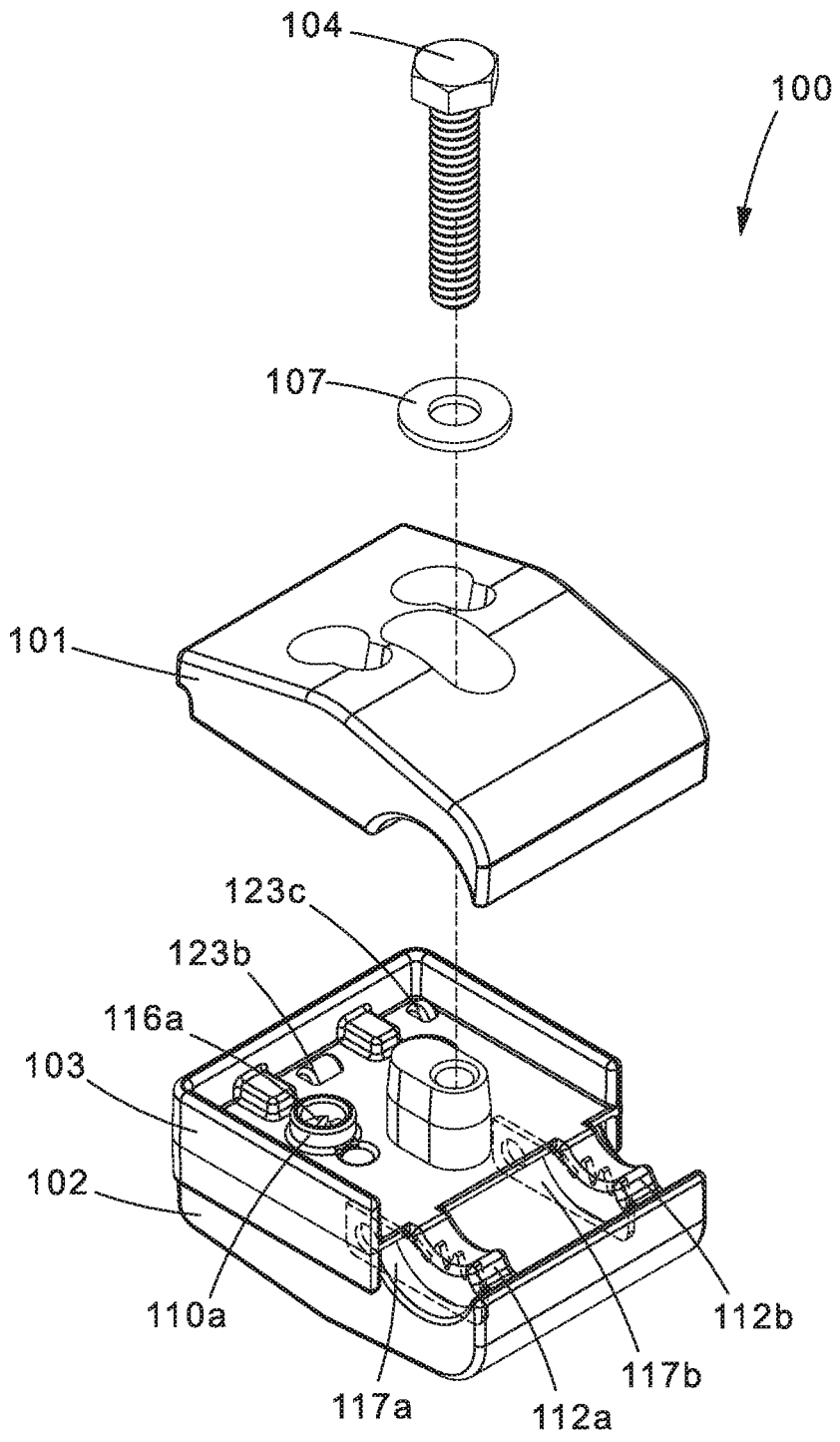
FIG. 5 is an exploded trimetric view of the example insulation piercing connector shown in FIG. 1.
Figure 6:
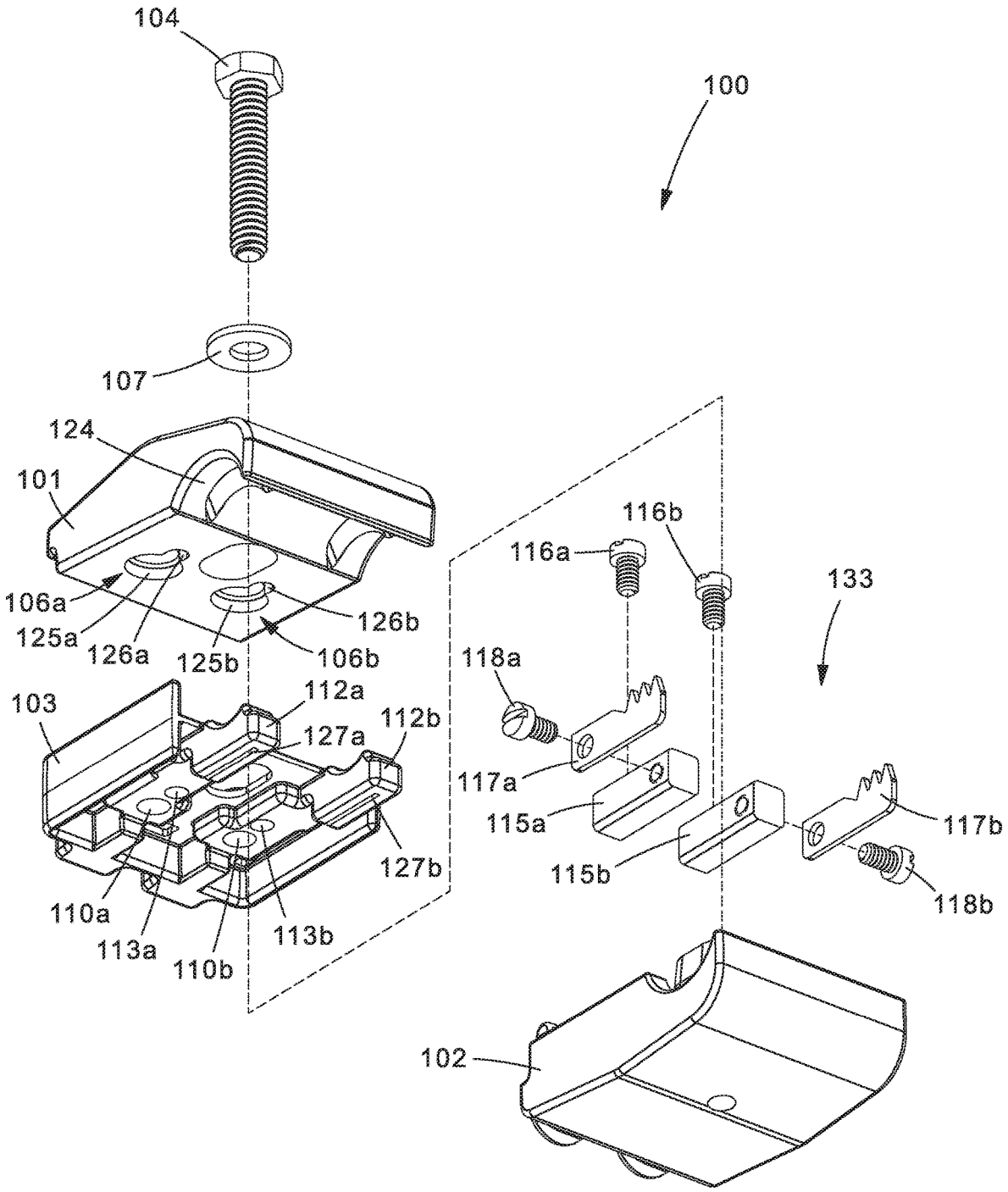
FIG. 6 is an exploded trimetric view of the example insulation piercing connector shown in FIG. 1.
Figure 7:
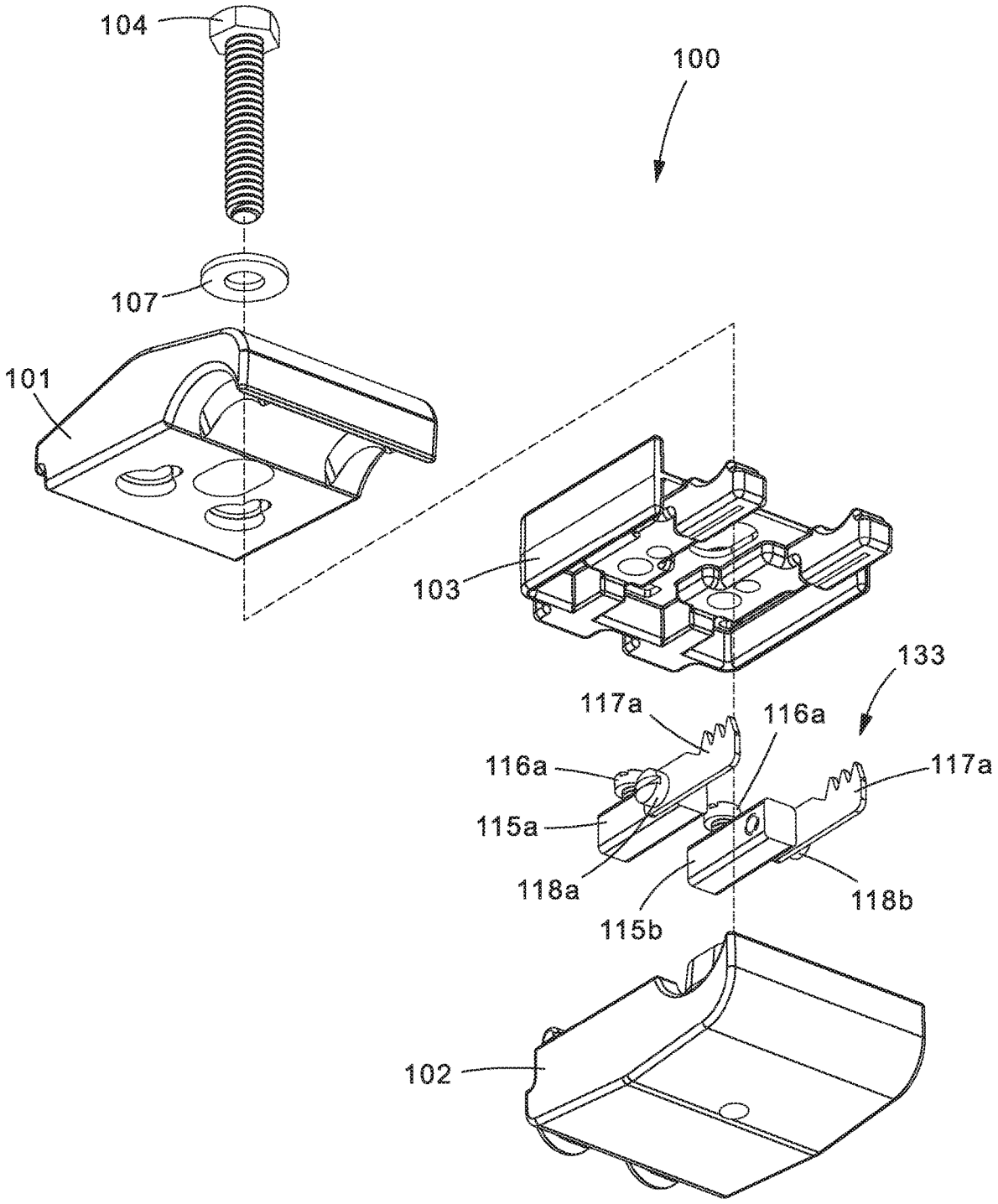
FIG. 7 is an exploded trimetric view of the example insulation piercing connector shown in FIG. 1.
Figure 8:
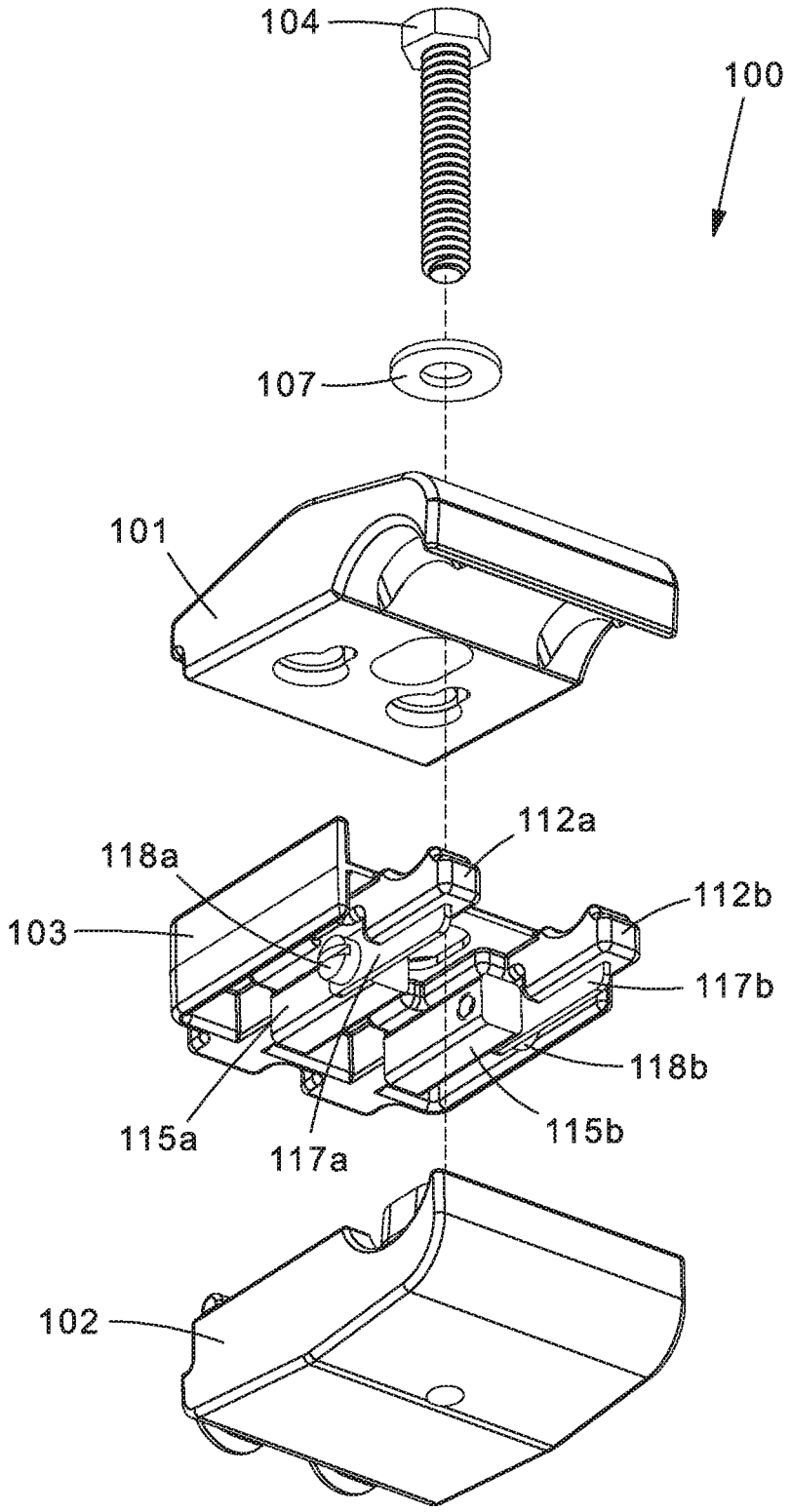
FIG. 8 is an exploded trimetric view of the example insulation piercing connector shown in FIG. 1.
Figure 9:
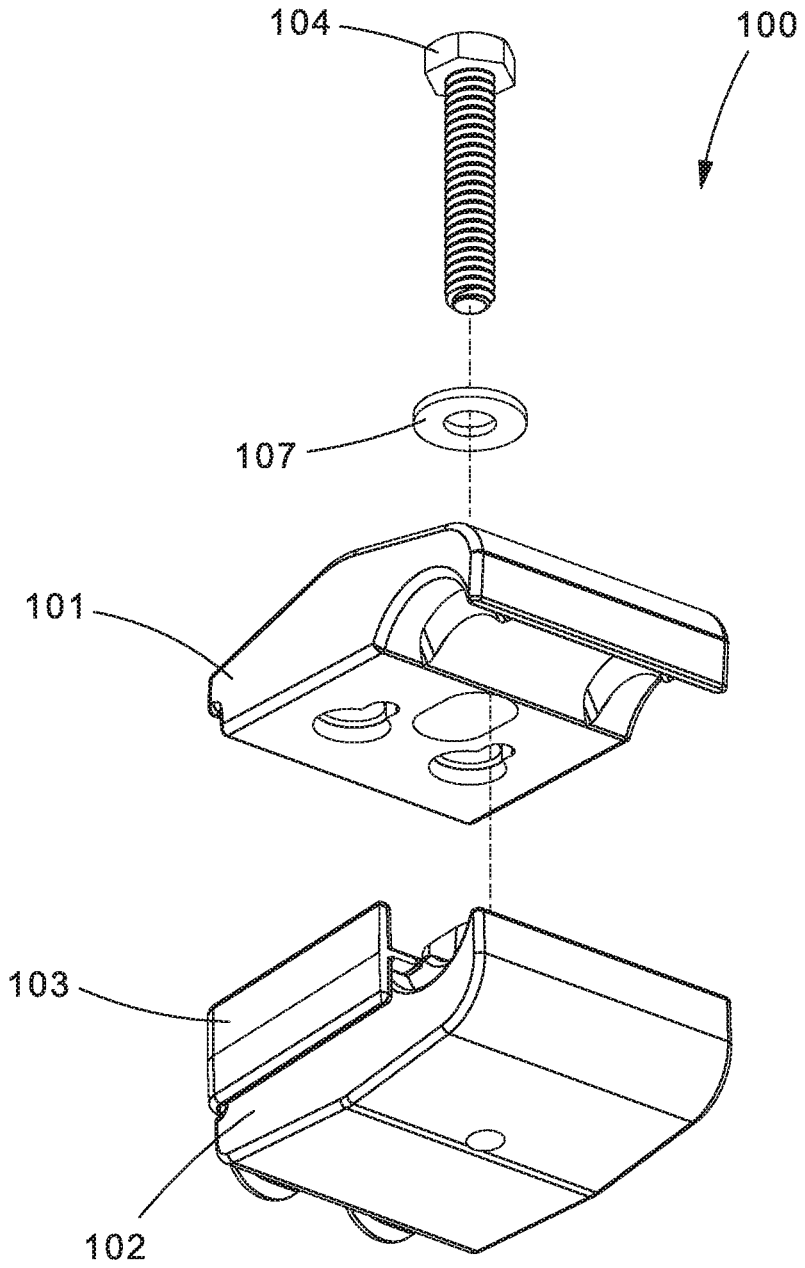
FIG. 9 is an exploded trimetric view of the example insulation piercing connector shown in FIG. 1.
Figure 10:
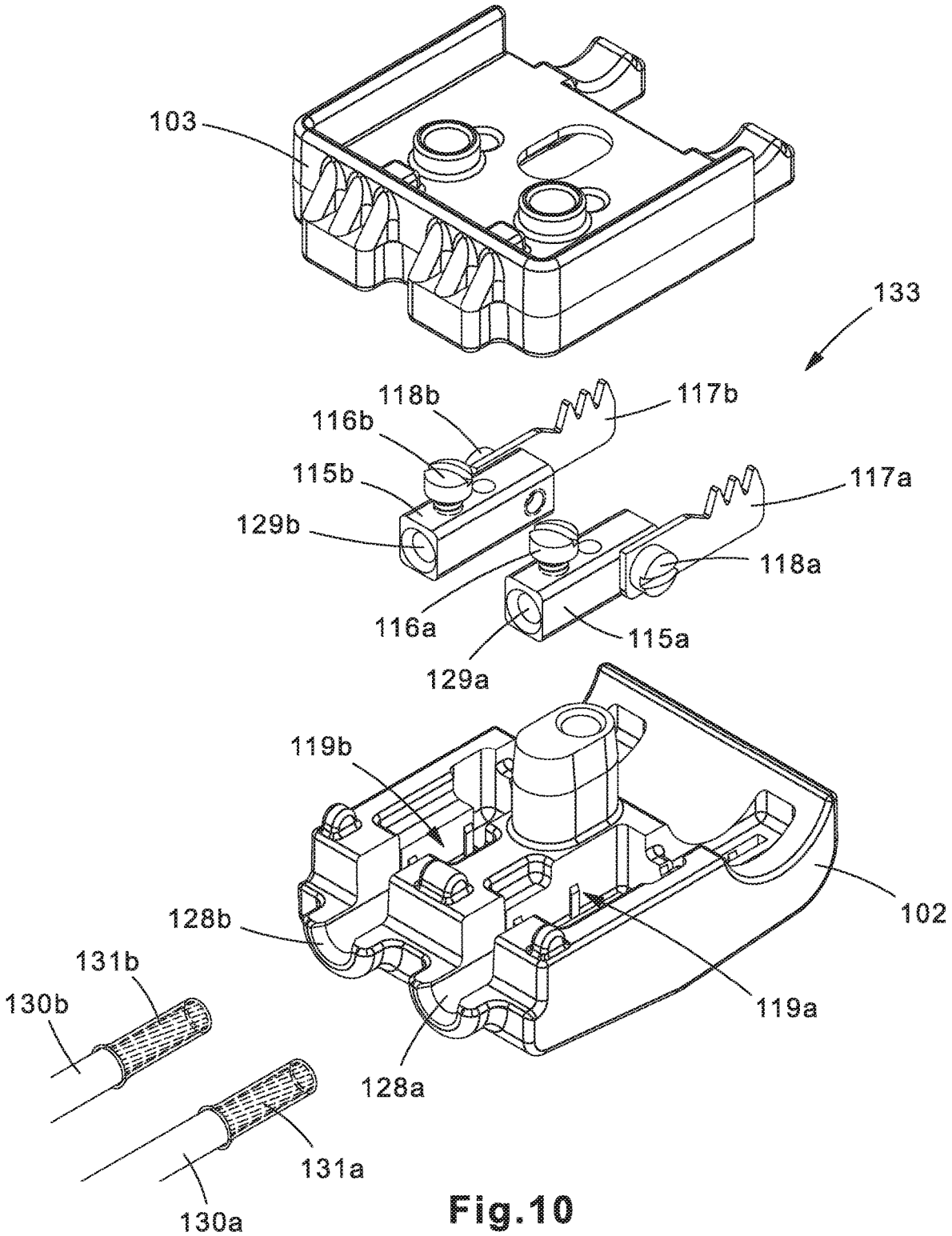
FIG. 10 is an exploded trimetric view of the example insulation piercing connector shown in FIG. 1 along with voltage detection conductors.
Figure 11:
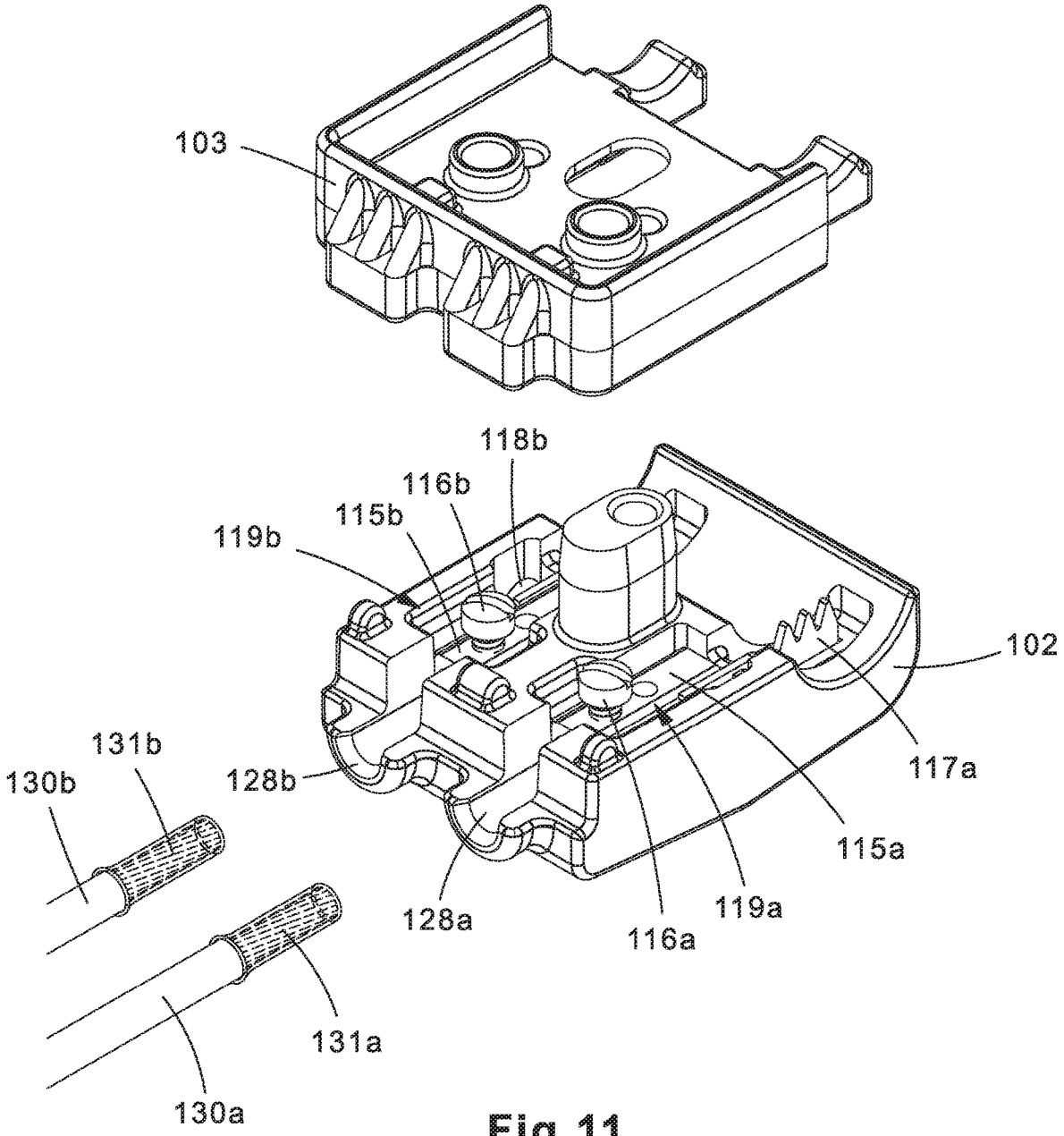
FIG. 11 is an exploded trimetric view of the example insulation piercing connector shown in FIG. 1 along with voltage detection conductors.
Figure 12:
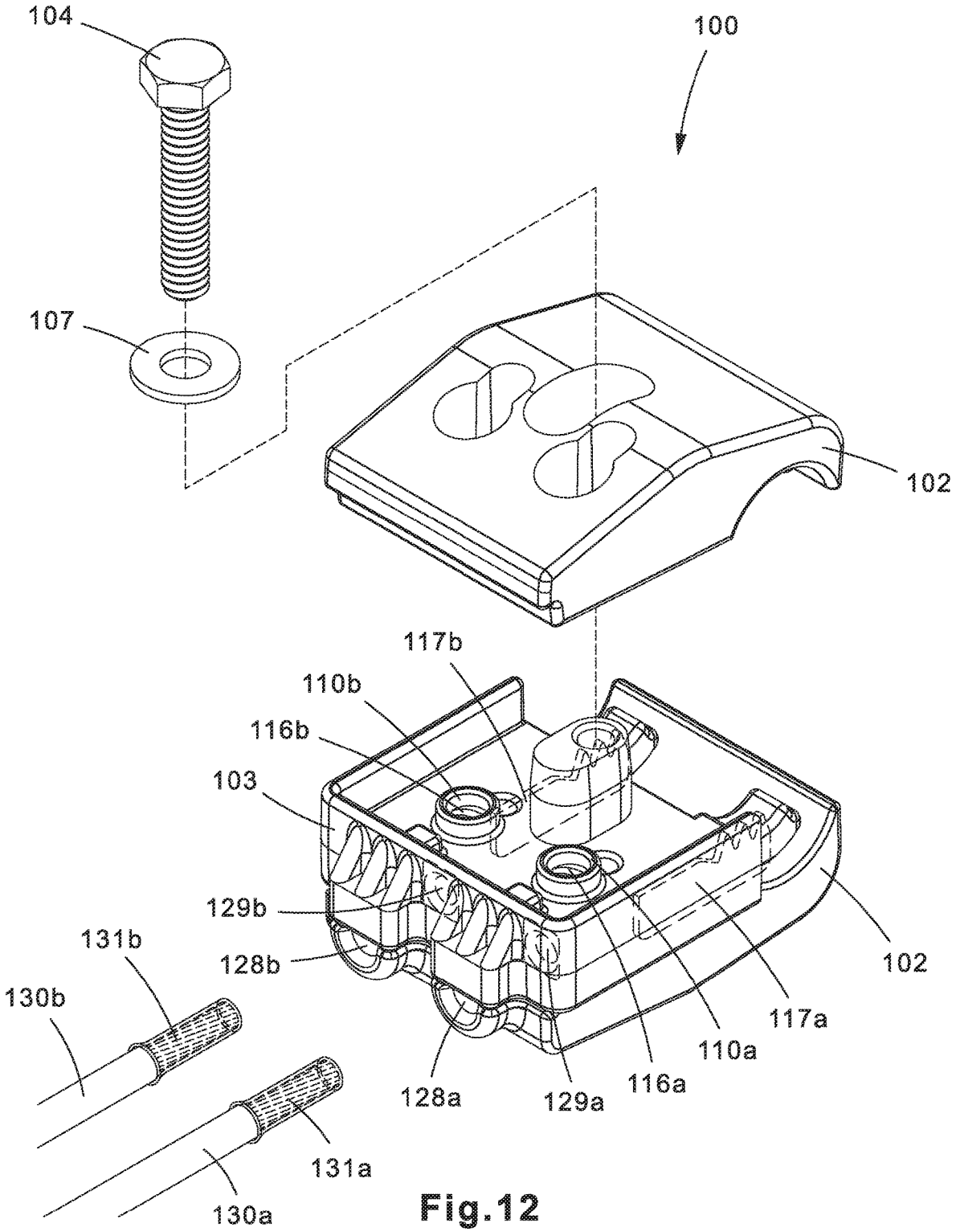
FIG. 12 is an exploded trimetric view of the example insulation piercing connector shown in FIG. 1 along with voltage detection conductors.
Figure 13:
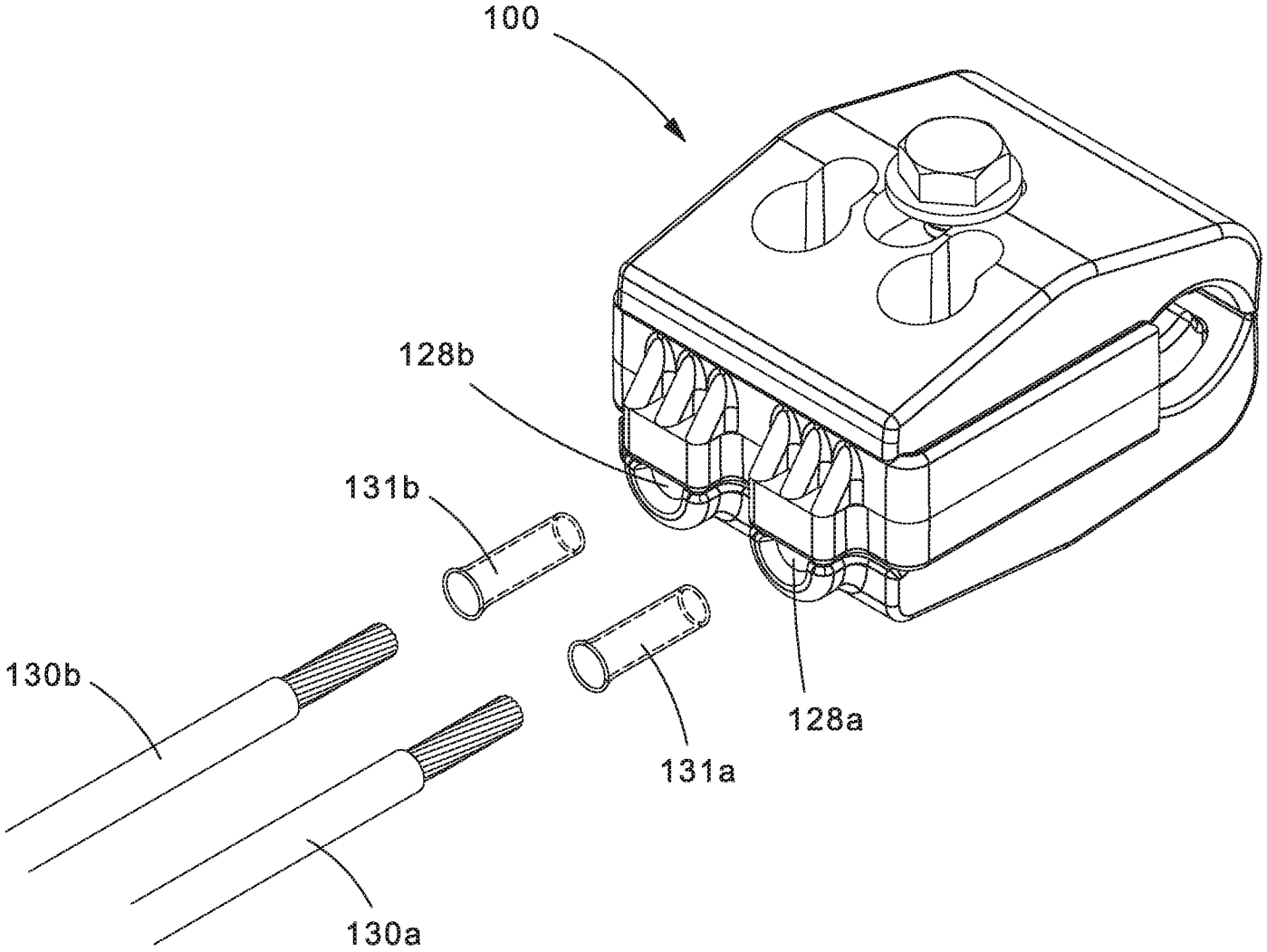
FIG. 13 is a trimetric view of the example insulation piercing connector shown in FIG. 1 along with voltage detection conductors.
Figure 14:
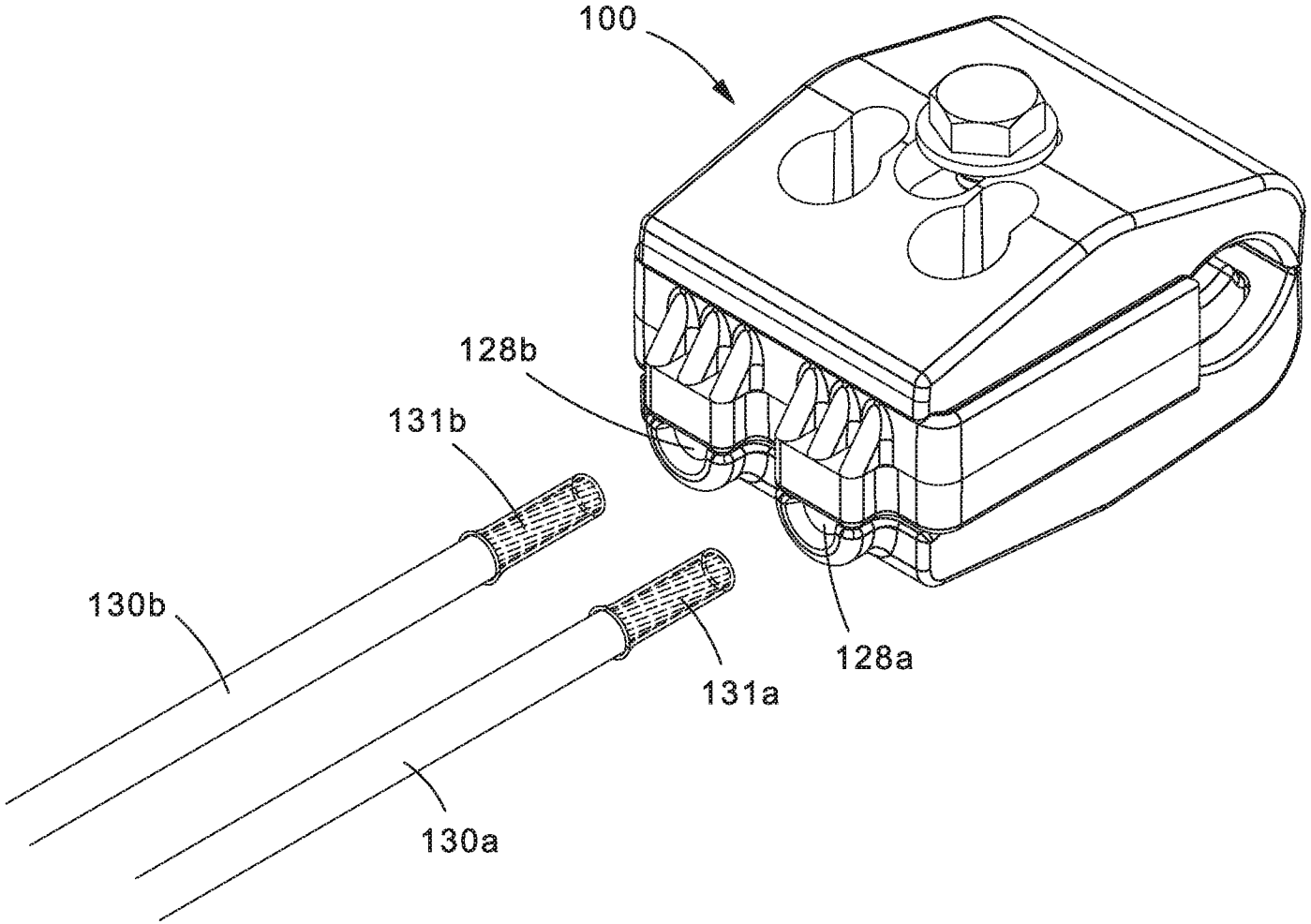
FIG. 14 is a trimetric view of the example insulation piercing connector shown in FIG. 1 along with voltage detection conductors.
Figure 15:
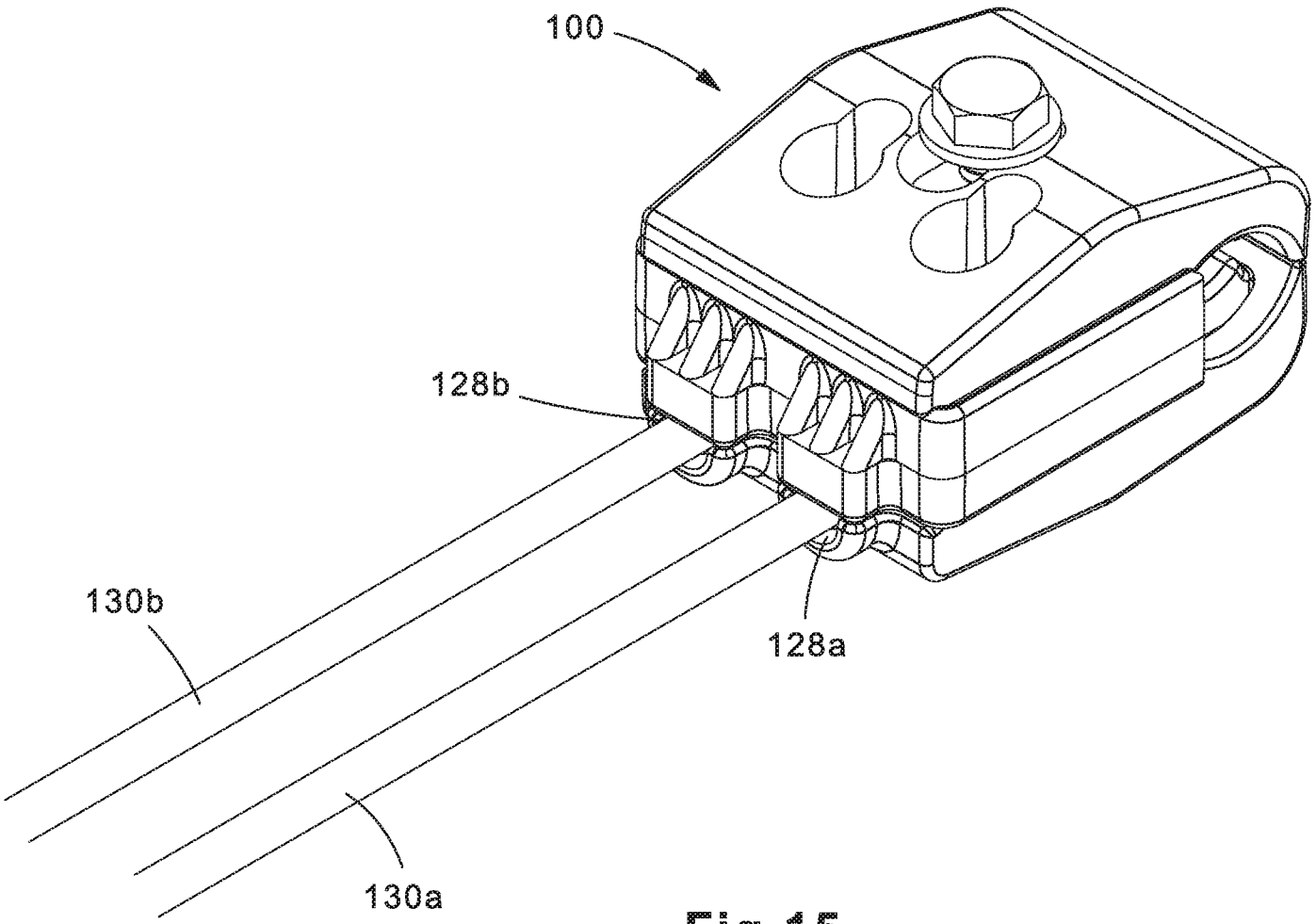
FIG. 15 is a trimetric view of the example insulation piercing connector shown in FIG. 1 attached to voltage detection conductors.
Figure 16:
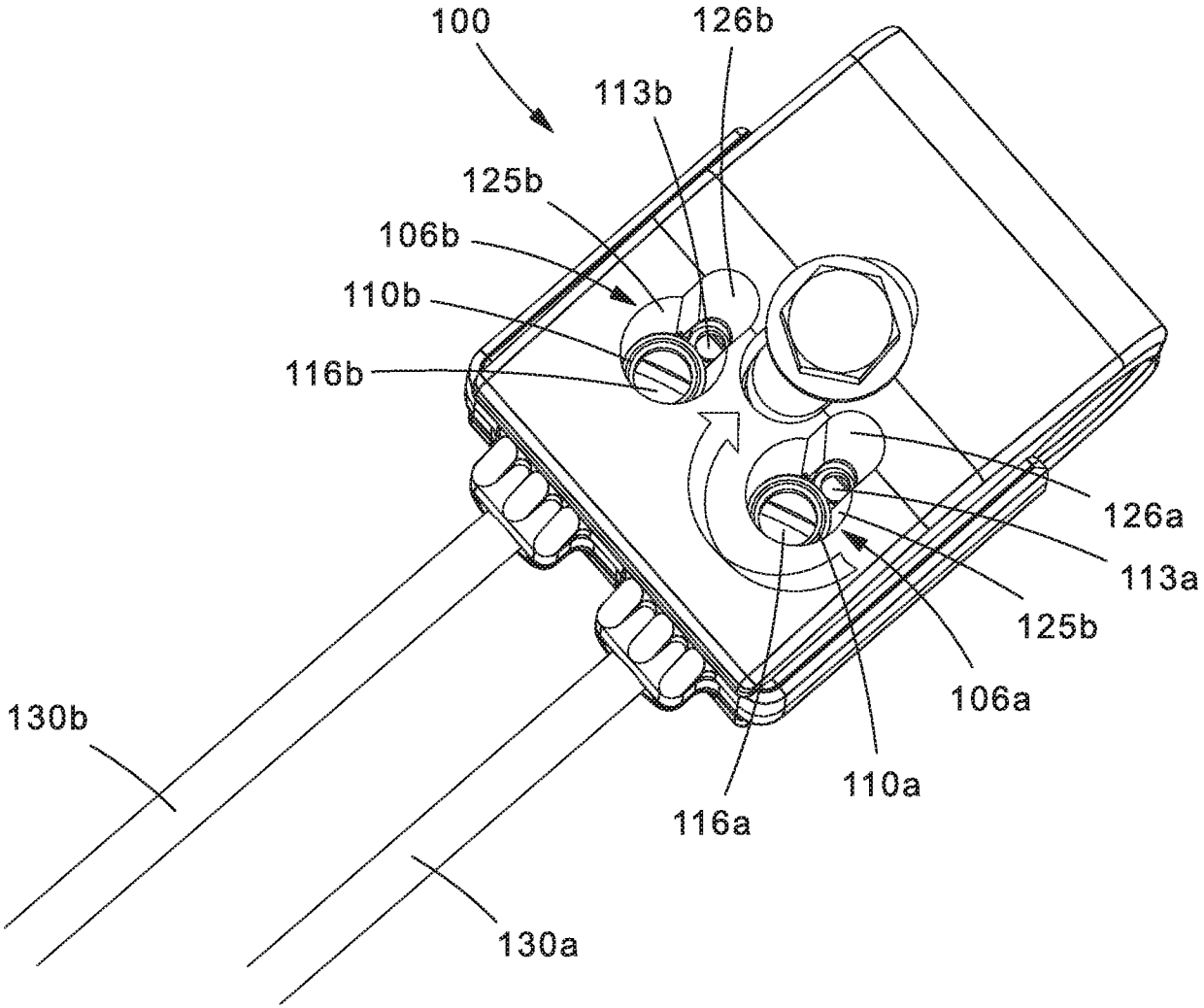
FIG. 16 is a trimetric view of the example insulation piercing connector shown in FIG. 1 attached to voltage detection conductors.
Figure 17:
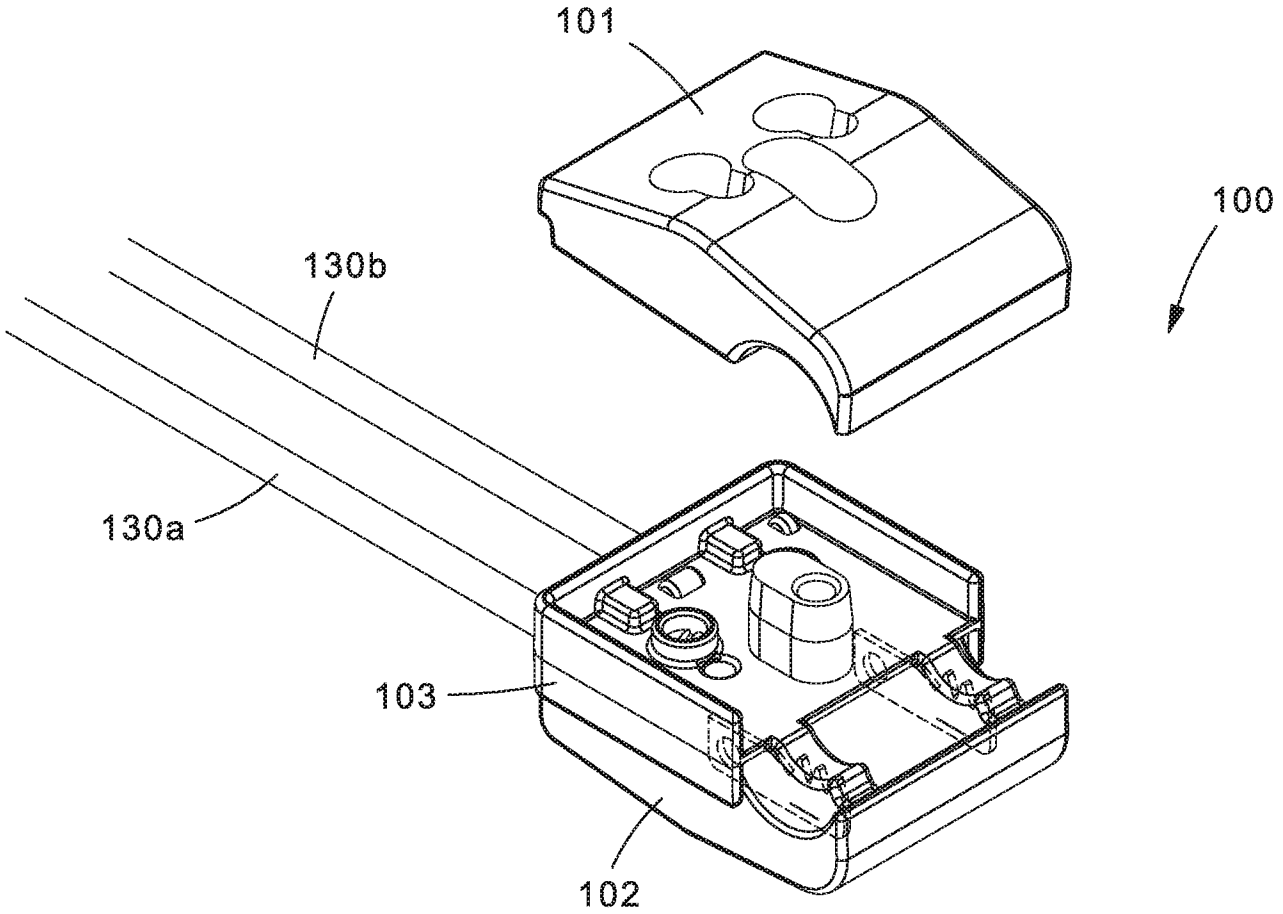
FIG. 17 is an exploded trimetric view of the example insulation piercing connector shown in FIG. 1 attached to voltage detection conductors.
Figure 18:
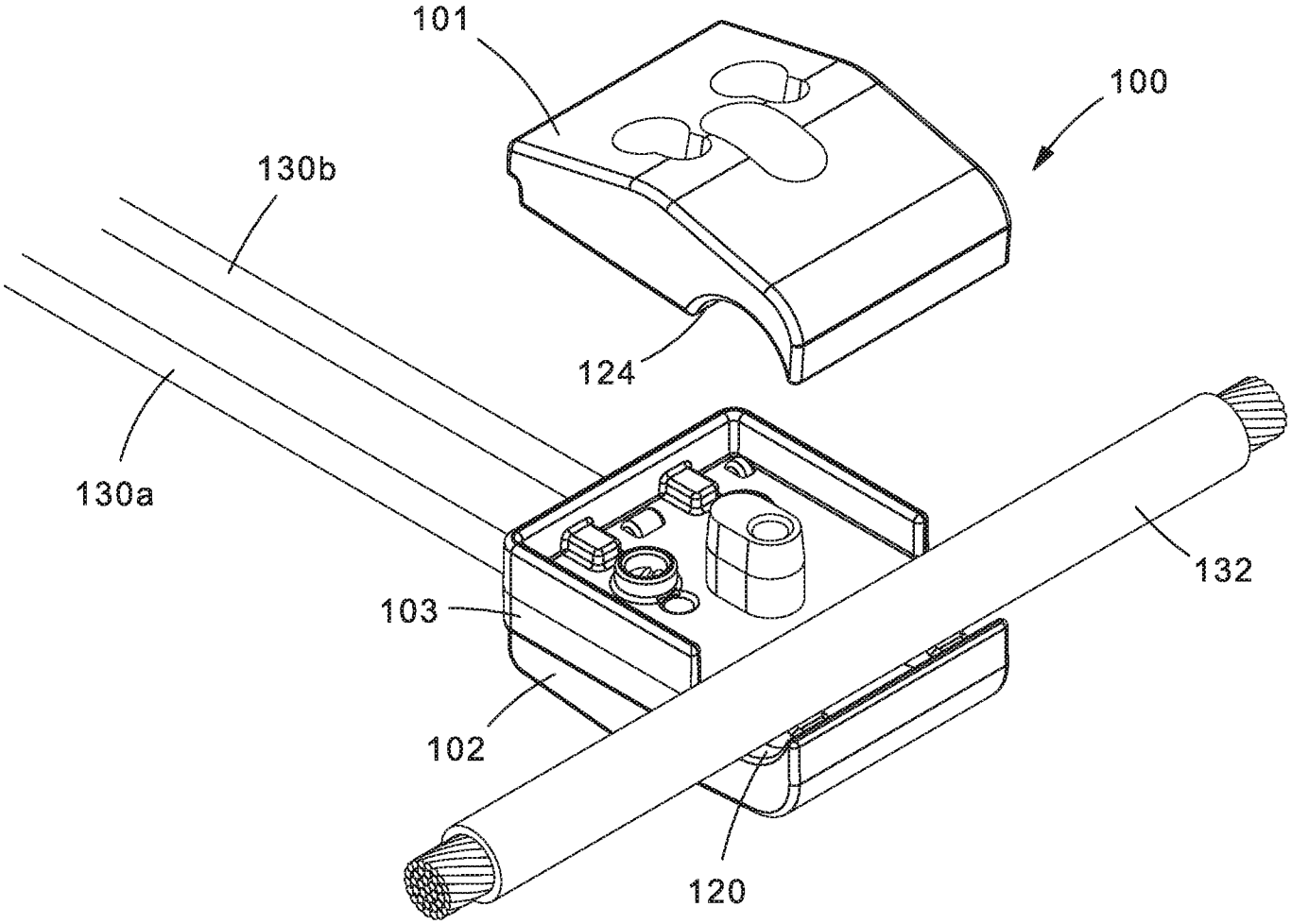
FIG. 18 is an exploded trimetric view of the example insulation piercing connector shown in FIG. 1 attached to voltage detection conductors along with a power cable.
Figure 19A:
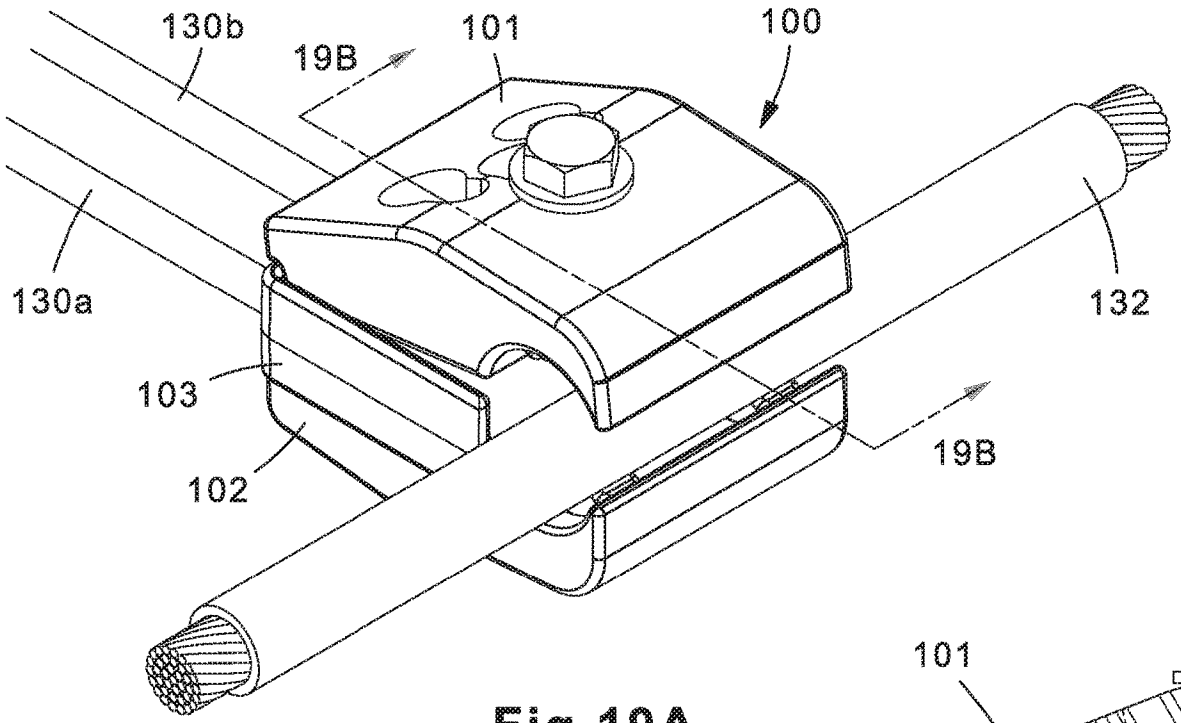
FIG. 19A is a trimetric view of the example insulation piercing connector shown in FIG. 1 attached to voltage detection conductors along with a power cable.
Figure 19B:
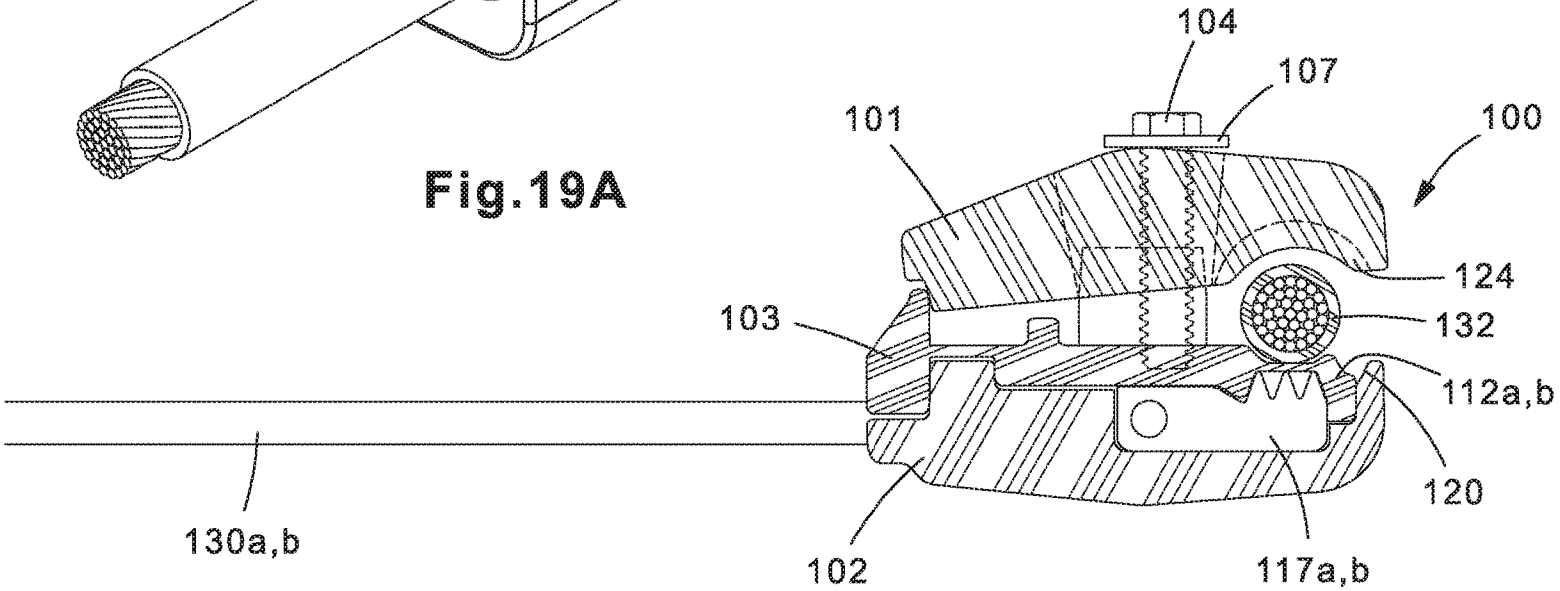
FIG. 19B is a cross-sectional view along line 19B-19B in FIG. 19A of the example insulation piercing connector shown in FIG. 1 attached to voltage detection conductors along with a power cable.
Figure 20A:
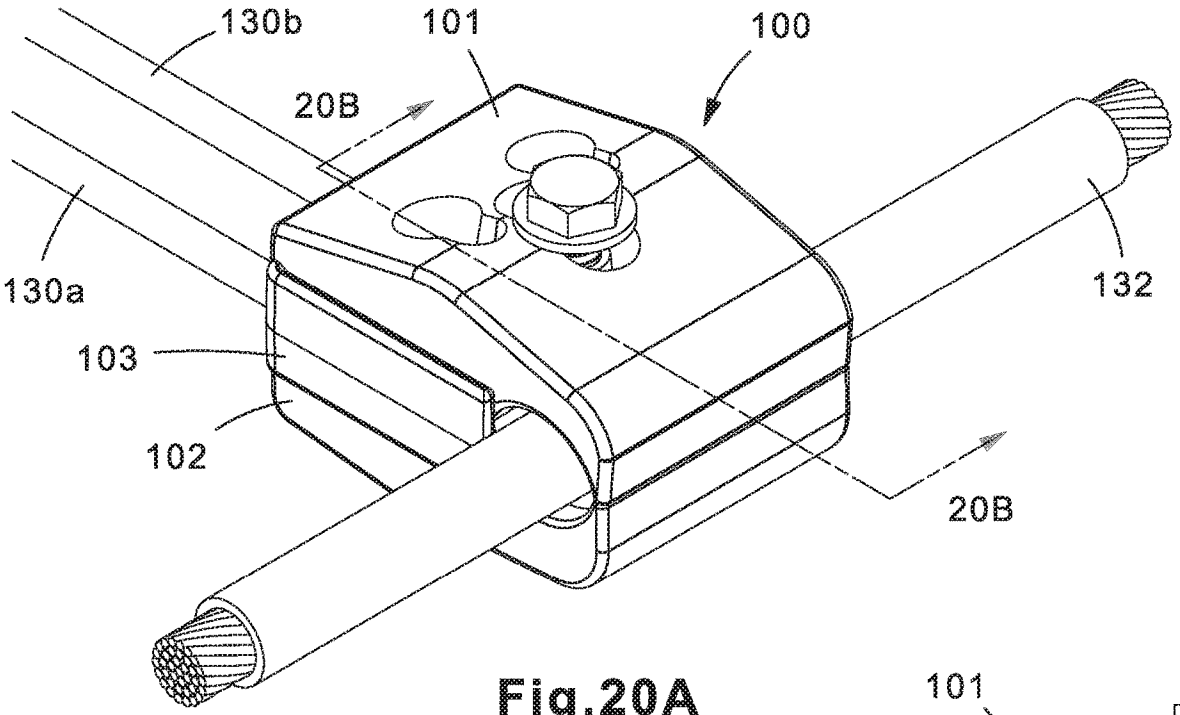
FIG. 20A is a trimetric view of the example insulation piercing connector shown in FIG. 1 attached to voltage detection conductors and a power cable.
Figure 20B:
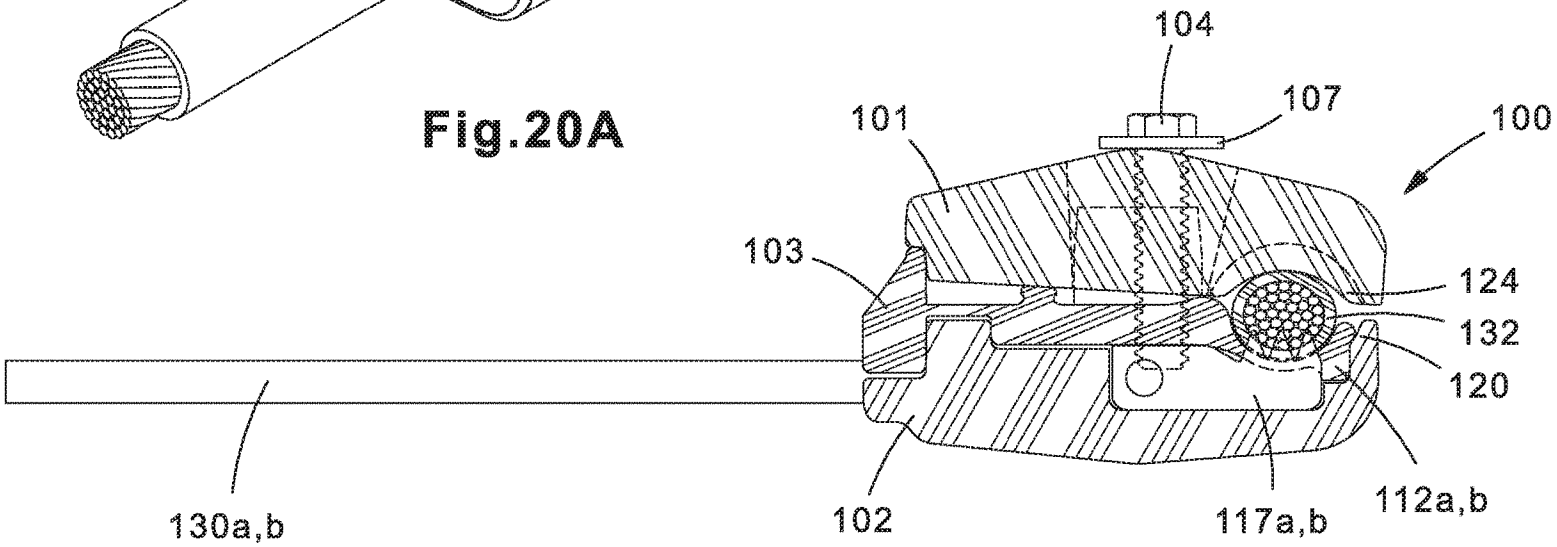
FIG. 20B is a cross-sectional view along line 20B-20B in FIG. 20A of the example insulation piercing connector shown in FIG. 1 attached to voltage detection conductors and a power cable.

FIGS. 1-18, 19A, 19B, 20A, and 20B are illustrations of an example insulation piercing connector 100. In some implementations, insulation piercing connector 100 may be used to provide a connection between voltage detection conductors 130*a*, 130*b* and a power cable 132 (FIGS. 10-20B). The connection may provide dual independent electrical connections between a voltage detection device (not shown) and power cable 132.

Insulation piercing connector 100 may include a top half 101, a bottom half 102, and a blade seal 103 held together by a fastener 104, such as a screw, bolt, or other types of fasteners. Top half 101 and bottom half 102 may be made of various insulating materials, such as various types of polymers/plastics. In one example, top half 101 and bottom half 102 may be made of a glass-filed nylon polymer. Blade seal 103 may be made of a rubber or elastomer. Fastener 104 may be made of an insulating material as well, or may be made of various metals.

A washer 107 (such as a ring washer, spring washer, or other types known in the art) may be positioned between the head of fastener 104 and top half 101 to evenly distribute the compression force applied by fastener 104. The threaded shaft of fastener 104 may be placed through hole 108 in top half 101, hole 111 in blade seal 103, and into a post 114. Post 114 may include a hole having threads therein, where the threads may be formed as integral part of post 114 or may be a metal or plastic threaded insert that is inserted into the hole in post 114. The threads of the threaded shaft of fastener 104 may engage with the threads in the hole in post 114 to compress top half 101, bottom half 102, and blade seal 103 together.

Insulation piercing assembly 133 may provide the electrical connection between power cable 132 (FIGS. 18-20B) and voltage detection conductors 130*a*, 130*b*. Insulation piercing assembly 133 may be made up of components formed of a conductive material such as copper. As shown in the exploded view of insulation piercing assembly 133 in FIG. 2, insulation piercing assembly 133 may include piercing blades 117*a*, 117*b* respectively attached to terminal housings 115*a*, 115*b* via fasteners (e.g., screws) 118*a*, 118*b*. The ends of voltage detection conductors 130*a*, 130*b* may be respectively inserted into terminal housings 115*a*, 115*b* and secured in place by fasteners 116*a*, 116*b*.

Insulation piercing assembly 133 may be positioned within bottom half 102 of insulation piercing connector 100. For example, insulation piercing assembly 133 may sit in recesses 119*a*, 119*b* of bottom half 102, with the teeth of piercing blades 117*a*, 117*b* respectively sitting in grooves 134*a*, 134*b*. In alternative implementations, insulation piercing assembly 133 may sit in recesses in top half 101.

Blade seal 103 may be positioned on top of bottom half 102 and insulation piercing assembly 133. Blade seal 103 may include a U-shaped sidewall 109 that partially overlaps a portion of top half 101 and bottom half 102. Blade seal 103 may also include notches 123*a-c* that may be positioned in holes 121*a-c* to ensure that blade seal 103 is properly aligned on top of bottom half 102 and insulation piercing assembly 133. Rubberized insulating seals 112*a*, 112*b* may respectively cover the teeth of piercing blades 117*a*, 117*b* prior to insulation piercing connector 100 being compressed around power cable 132, at which point the teeth of piercing blades 117*a*, 117*b* penetrate insulating seals 112*a*, 112*b*. Insulating seals 112*a*, 112*b* prevent voltage leakage from the connection between piercing blades 117*a*, 117*b* and power cable 132 by forming a seal around the portion of the insulating layer penetrated by piercing blades 117*a*, 117*b*. The teeth of piercing blades 117*a*, 117*b* may be positioned respectfully within grooves 127*a*, 127*b* of insulating seals 112*a*, 112*b*.

Top half 101 may be placed on top of blade seal 103. Top half 101 and bottom half 102 may respectively have first round ends 124 and 120. When top half 101, bottom half 102, and blade seal 103 are all assembled, round ends 124 and 120 may form a recess 105 in which power cable 132 may be positioned.

As depicted in FIGS. 18-20B, in operation, to attach insulation piercing clamp 100 to power cable 132, fastener 104 may be loosened to a point where there is enough space between top half 101 and bottom half 102 to insert power cable 132 into recess 105. Fastener 104 may then be tightened so that a compression force is applied to top half 101 and bottom half 102. The compression force causes the teeth of piercing blades 117*a*, 117*b* to respectively pierce through insulating seals 112*a*, 112*b*, exposing them to the insulation layer around power cable 132. As top half 101 and bottom half 102 compress together further, the teeth of piercing blades 117*a*, 117*b* may pierce through the insulation layer to the core of power cable 132 (which may be solid or stranded), thereby providing dual independent electrical connections to power cable 132. Insulating seals 112*a*, 112*b* prevent voltage leakage at the connection points.

As depicted in FIGS. 13-16, to attach voltage detection conductors 130*a*, 130*b* to terminal housings 115*a*, 115*b*, an installer may insert the conductive ends of voltage detection conductors 130*a*, 130*b* respectively into openings 128*a*, 128*b*, and into holes 129*a*, 129*b* of terminal housings 115*a*, 115*b*. Ferrules 131*a*, 131*b* may be installed over the conductive ends of voltage detection conductors 130*a*, 130*b* to provide improved electrical connection with terminal housings 115*a*, 115*b*.

The installer may view voltage detection conductors 130*a*, 130*b* through viewing holes to visually verify that voltage detection conductors 130*a*, 130*b* (or ferrules 131*a*, 131*b*, if installed) have been fully inserted into terminal housings 115*a*, 115*b*. For example, top half 101 may include recesses 106*a*, 106*b* that are subdivided into access holes 125*a*, 125*b* and viewing holes 126*a*, 126*b*; blade seal 103 may also include viewing holes 113*a*, 113*b* that align with viewing holes 126*a*, 126*b* of top half 101; and terminal housings 115*a*, 115*b* may include viewing holes 122*a*, 122*b* that align with viewing holes 113*a*, 113*b* of blade seal 103 and viewing holes 126*a*, 126*b* of top half 101. The installer may view voltage detection conductors 130*a*, 130*b* through the series of viewing holes in top half 101 and blade seal 103 as they are inserted into terminal housings 115*a*, 115*b*, and may secure voltage detection conductors 130*a*, 130*b* in terminal housings 115*a*, 115*b* view fasteners 116*a*, 116*b* once the installer has verified that voltage detection conductors 130*a*, 130*b* have been fully inserted into terminal housings 115*a*, 115*b*.

The installer may secure voltage detection conductors 130*a*, 130*b* in terminal housings 115*a*, 115*b* by inserting a fastening tool, such as a screw driver through access holes 125*a*, 125*b* in top half 101, and access holes 110*a*, 110*b* in blade seal 103, to tighten fasteners 116*a*, 116*b*.

Figure 21:
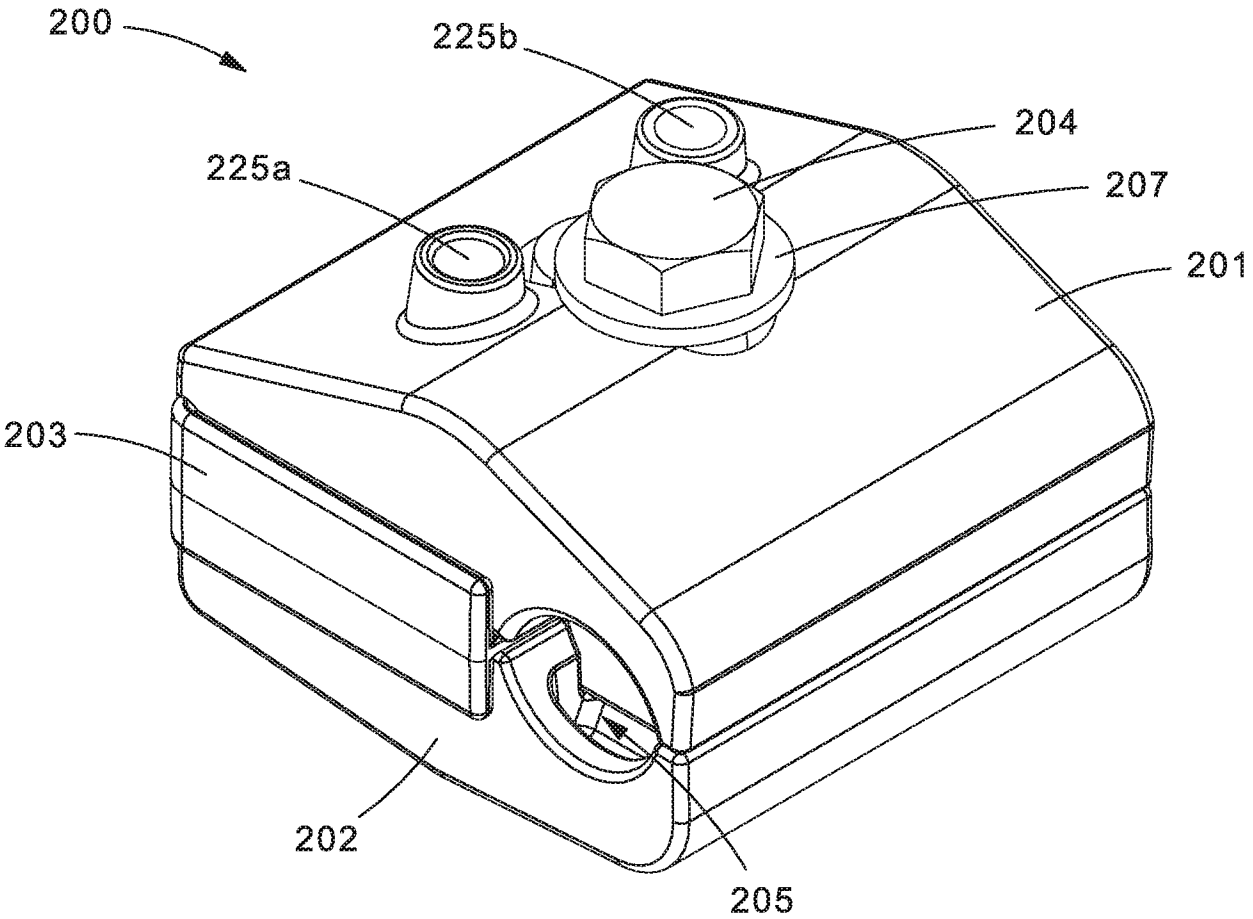
FIG. 21 is a trimetric view of a second example insulation piercing connector.
Figure 22:
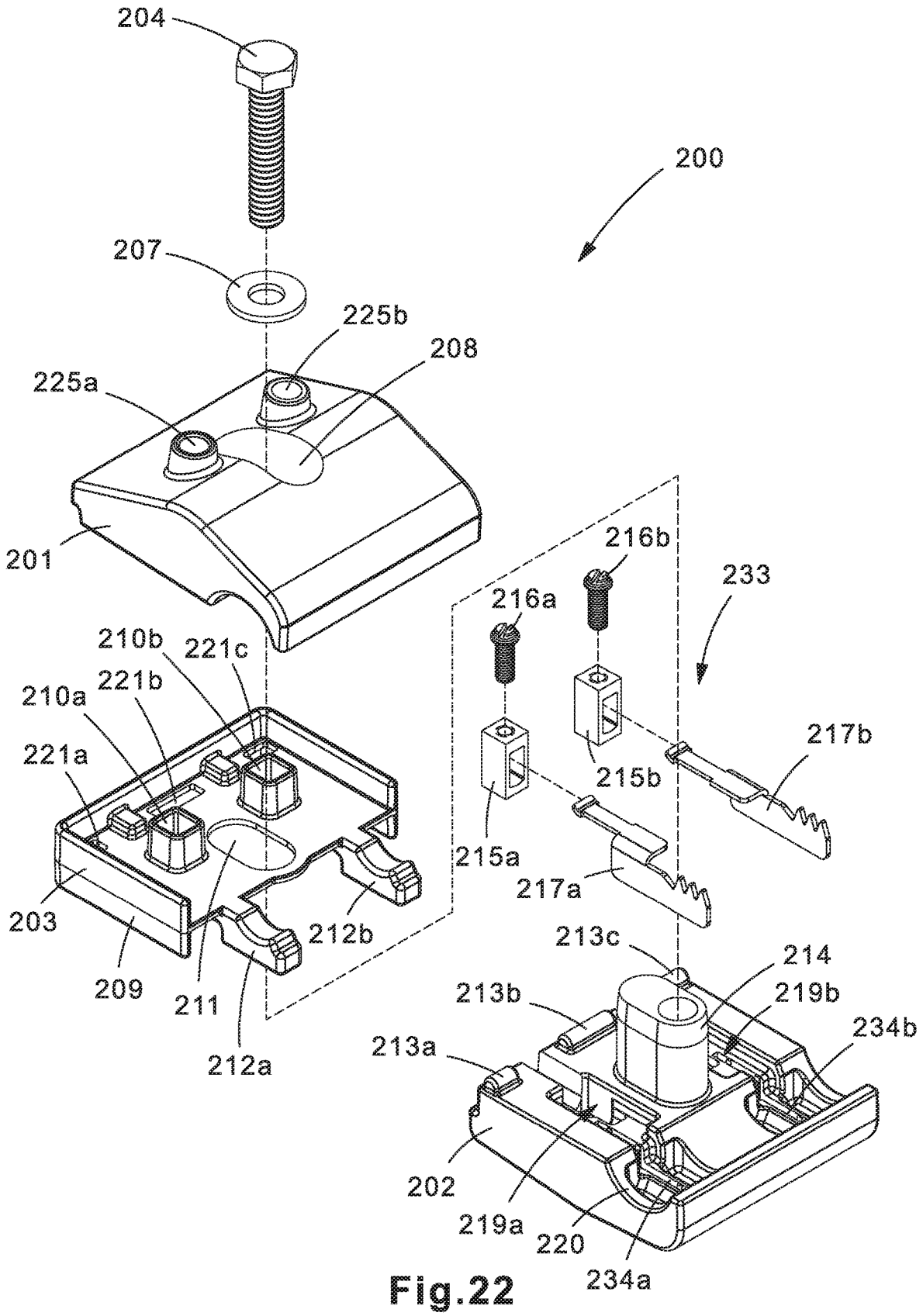
FIG. 22 is an exploded trimetric view of the example insulation piercing connector shown in FIG. 21.
Figure 23:
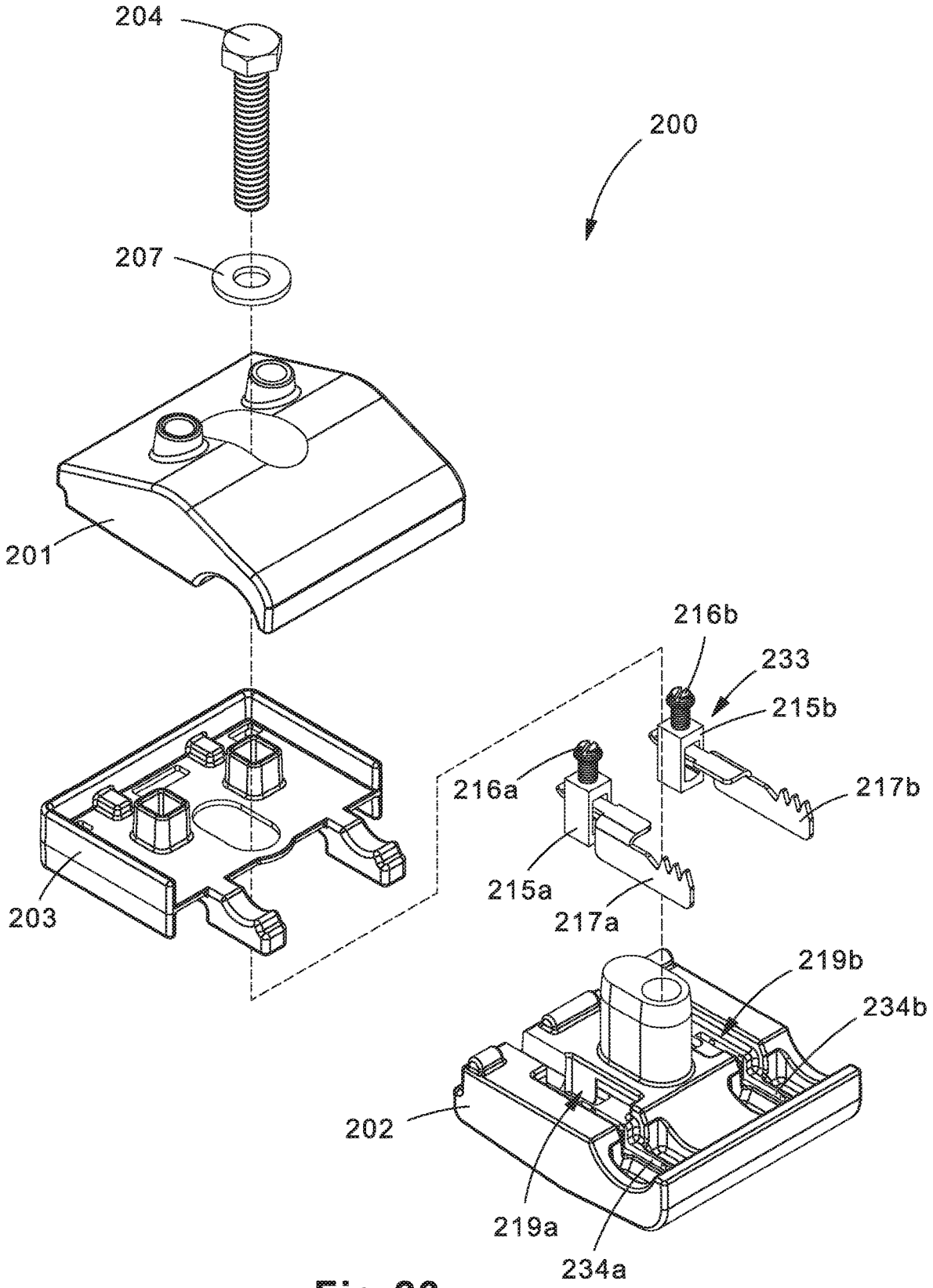
FIG. 23 is an exploded trimetric view of the example insulation piercing connector shown in FIG. 21.
Figure 24:
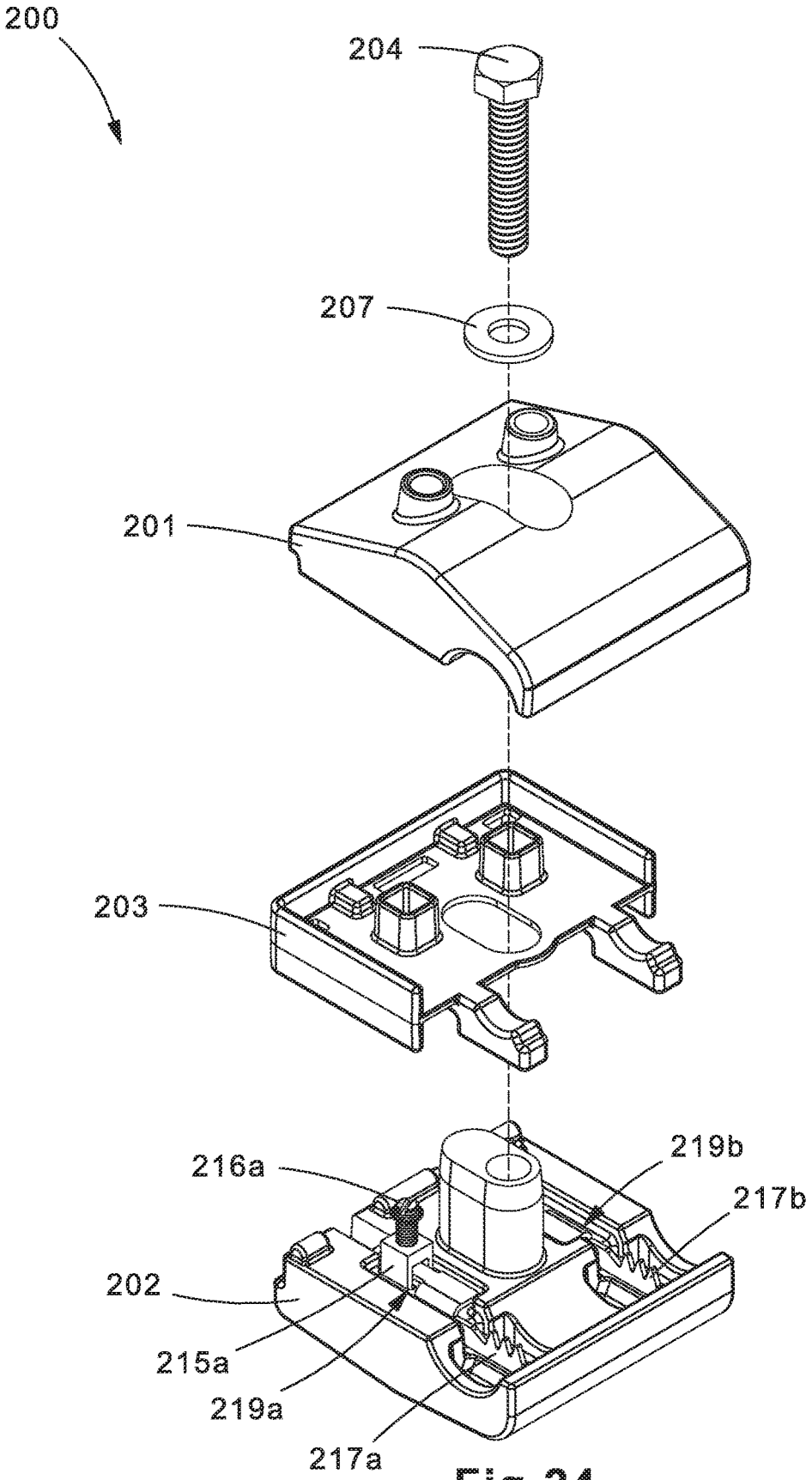
FIG. 24 is an exploded trimetric view of the example insulation piercing connector shown in FIG. 21.
Figure 25:
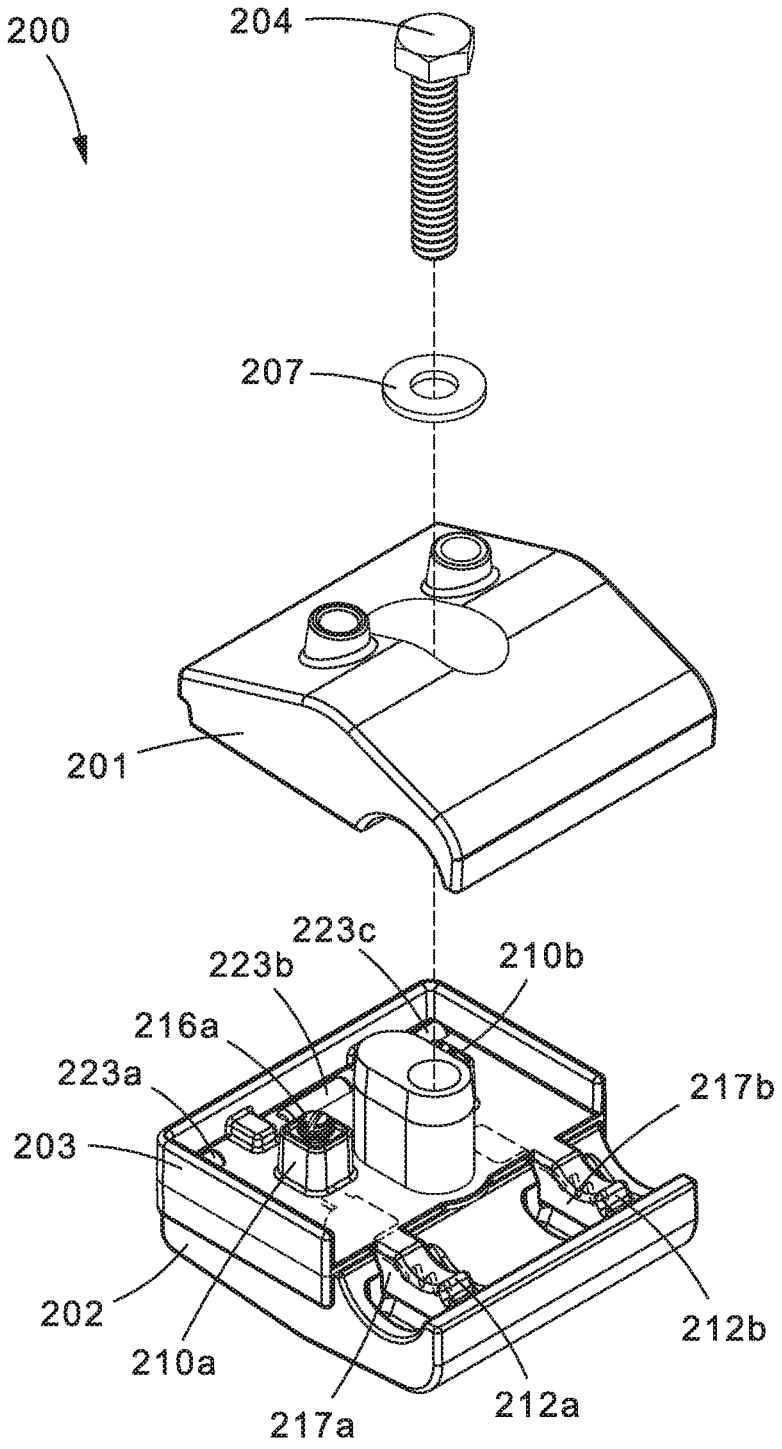
FIG. 25 is an exploded trimetric view of the example insulation piercing connector shown in FIG. 21.
Figure 26:
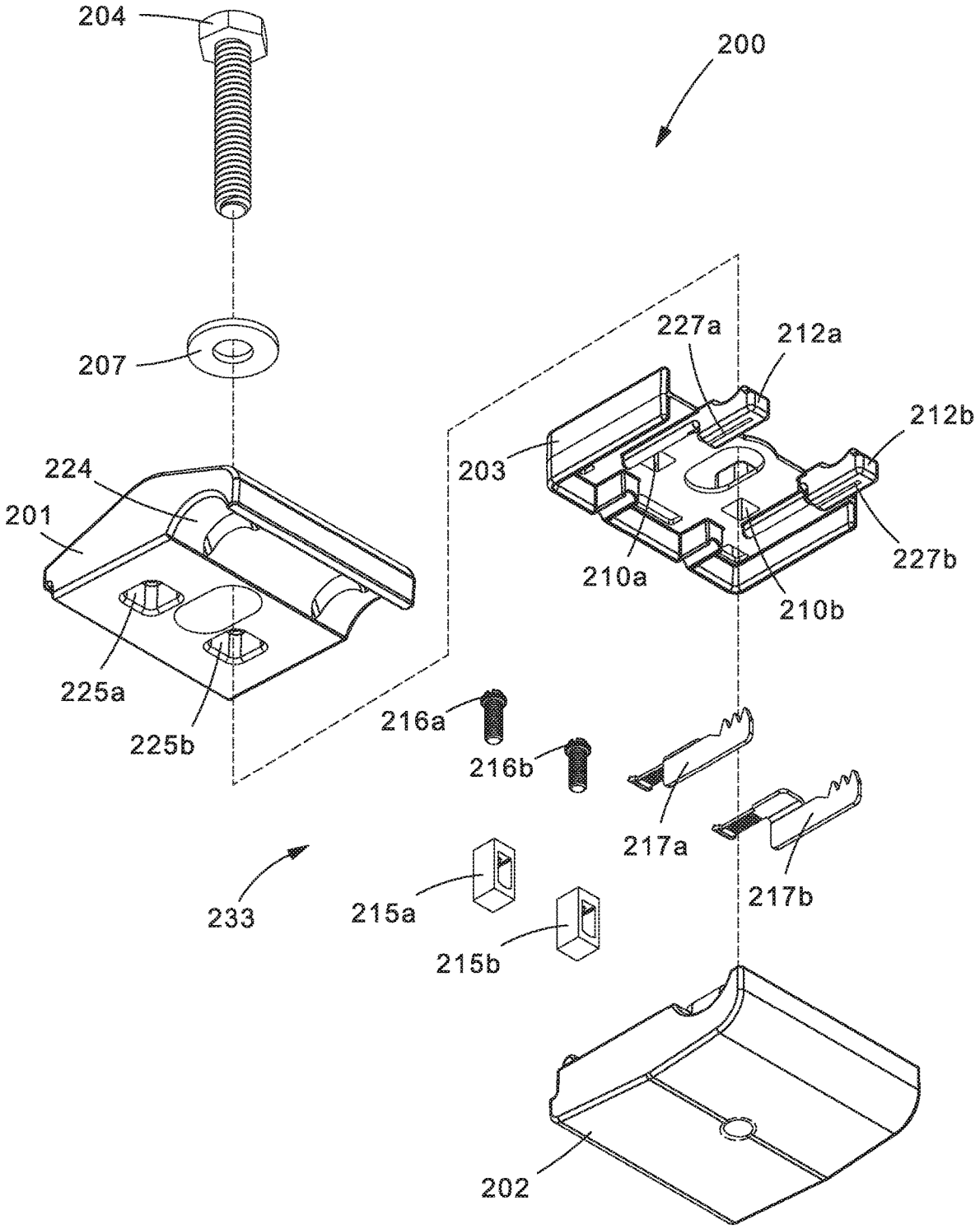
FIG. 26 is an exploded trimetric view of the example insulation piercing connector shown in FIG. 21.
Figure 27:
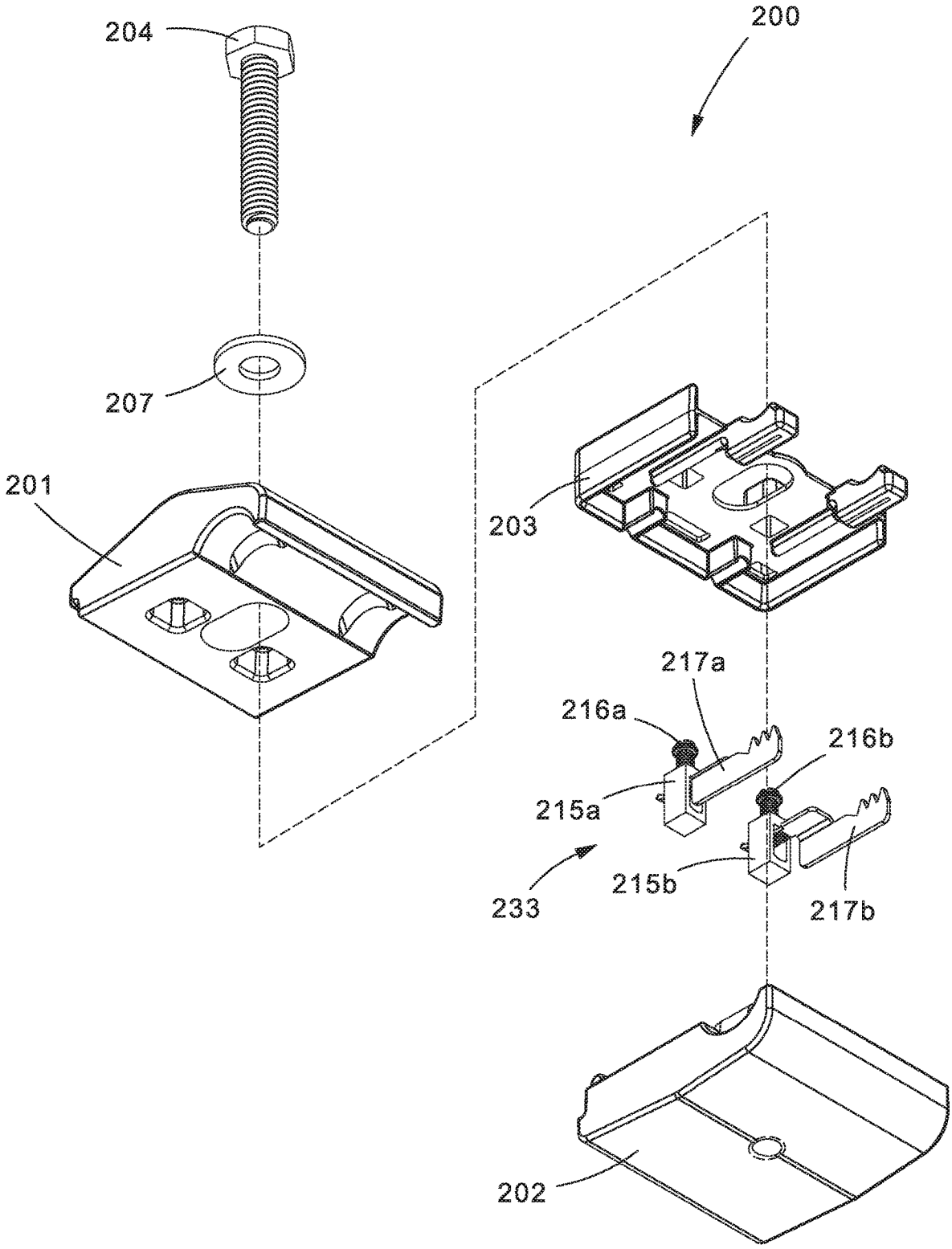
FIG. 27 is an exploded trimetric view of the example insulation piercing connector shown in FIG. 21.
Figure 28:
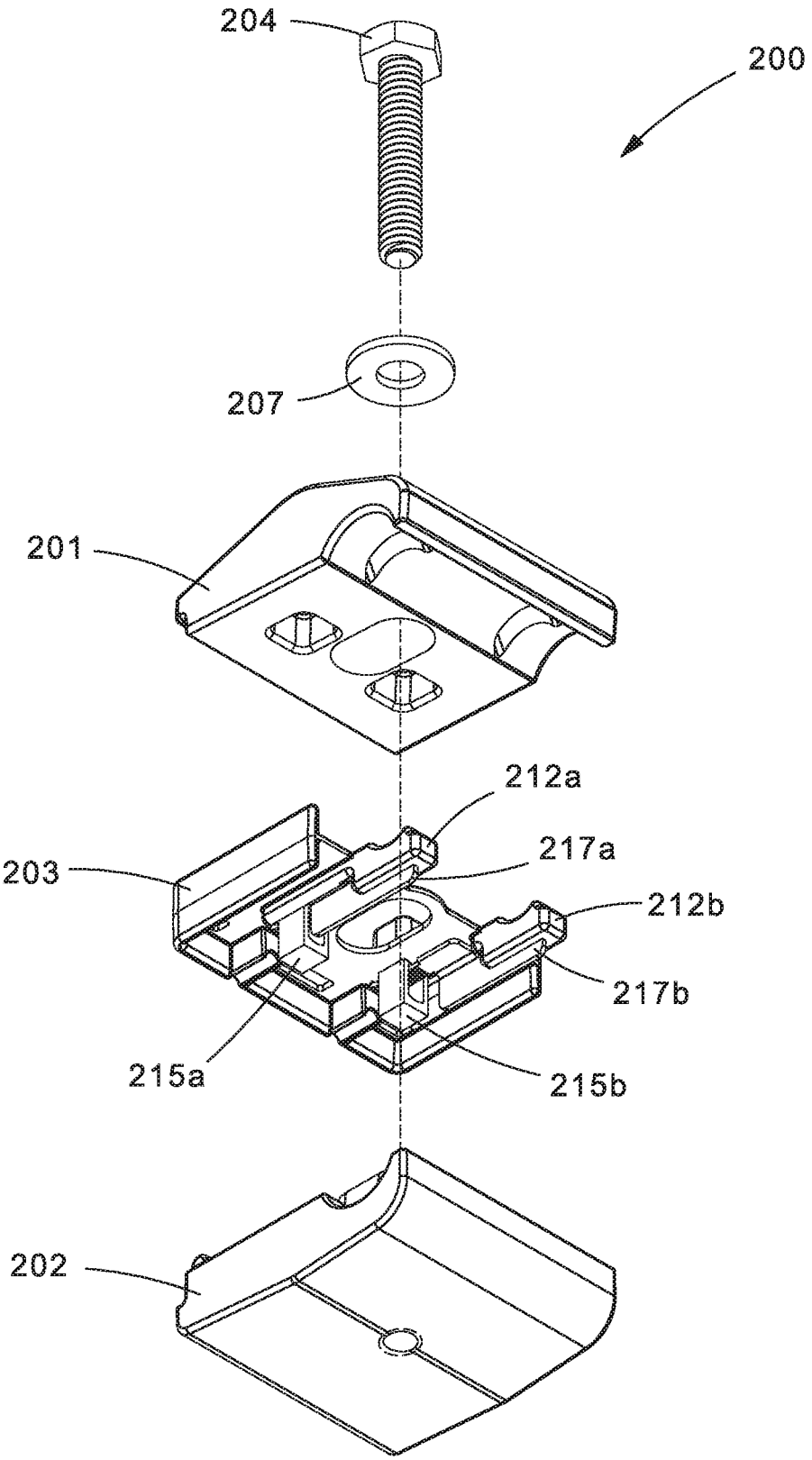
FIG. 28 is an exploded trimetric view of the example insulation piercing connector shown in FIG. 21.
Figure 29:
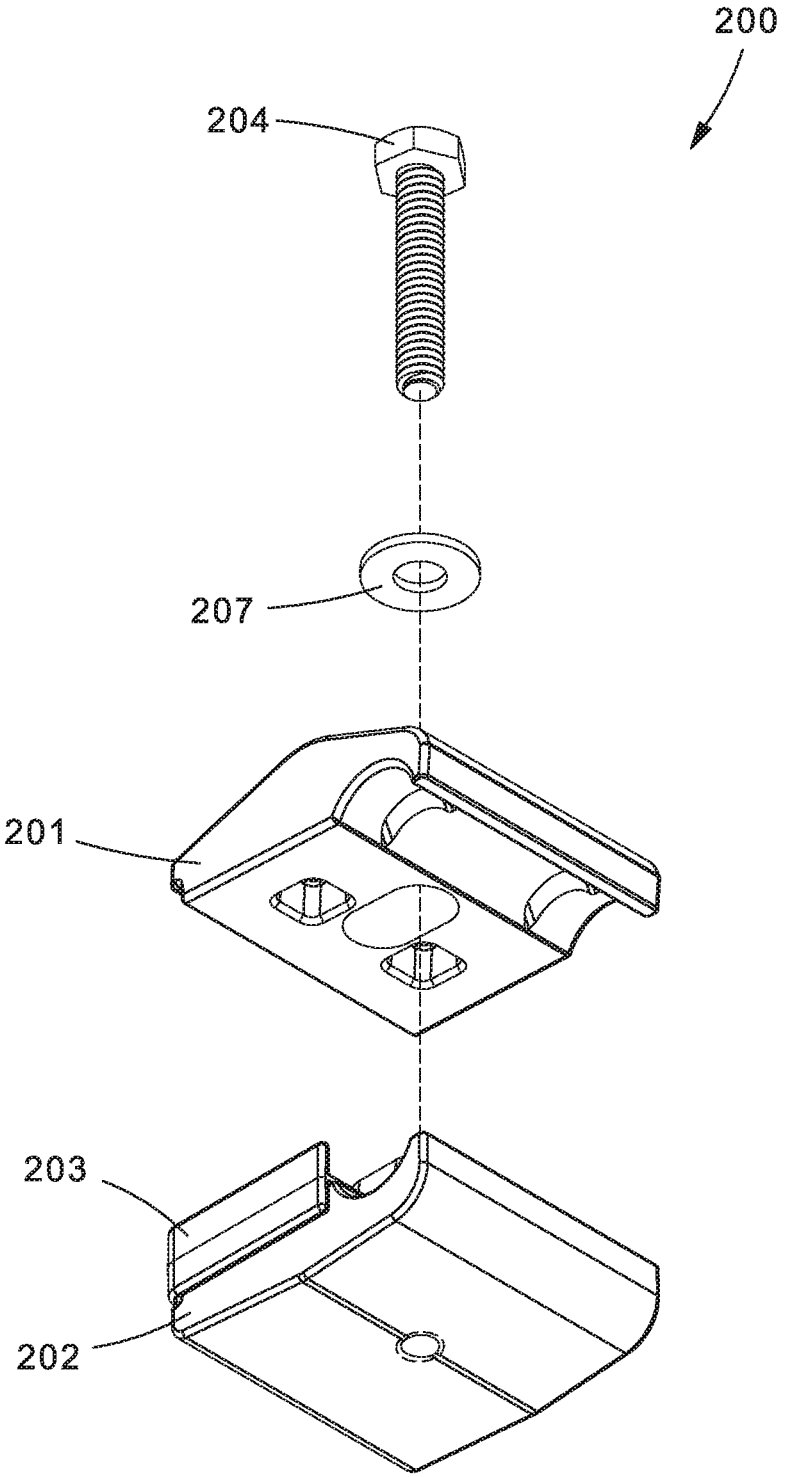
FIG. 29 is an exploded trimetric view of the example insulation piercing connector shown in FIG. 21.
Figure 30:
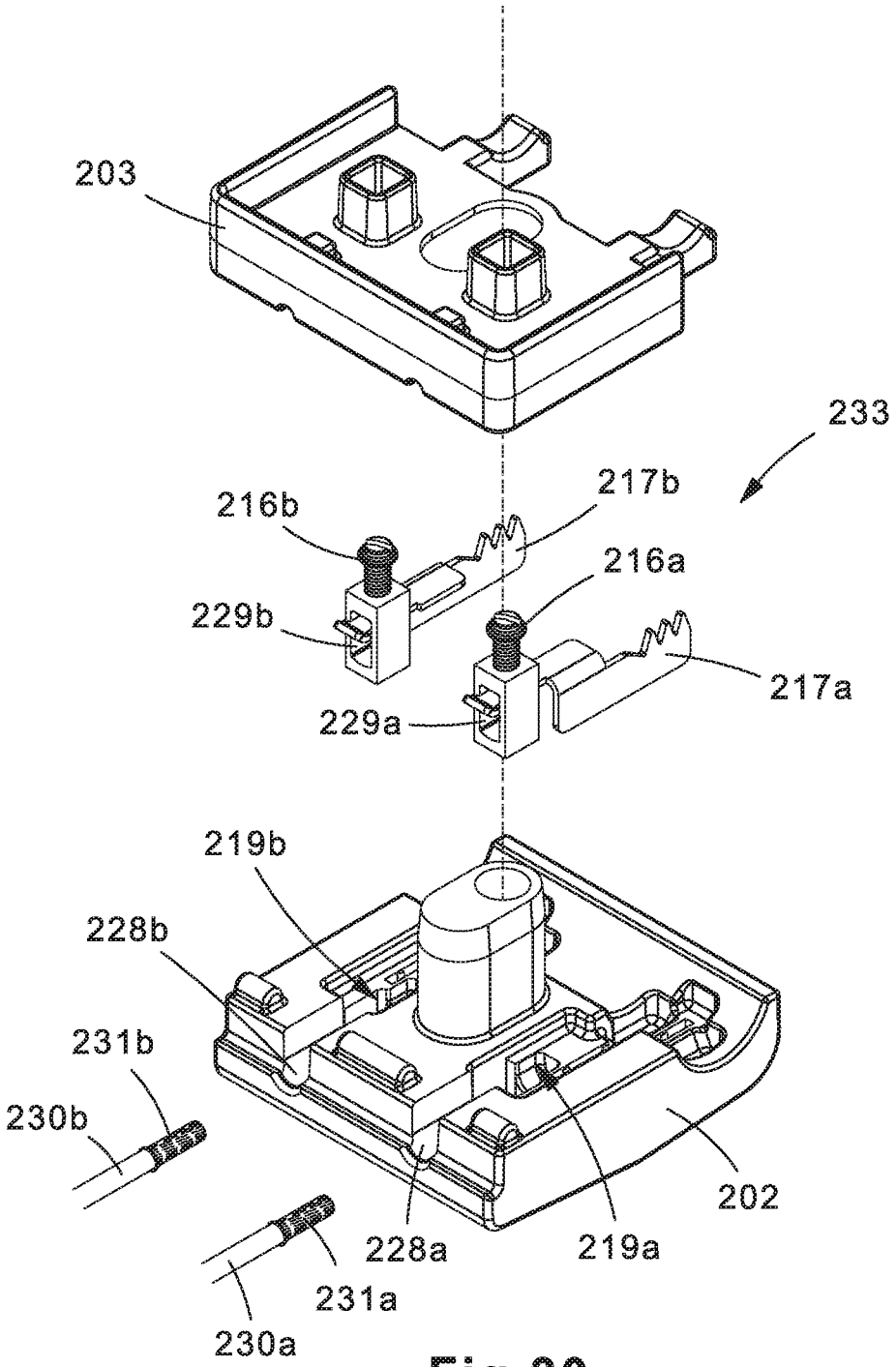
FIG. 30 is an exploded trimetric view of the example insulation piercing connector shown in FIG. 21 along with voltage detection conductors.
Figure 31:
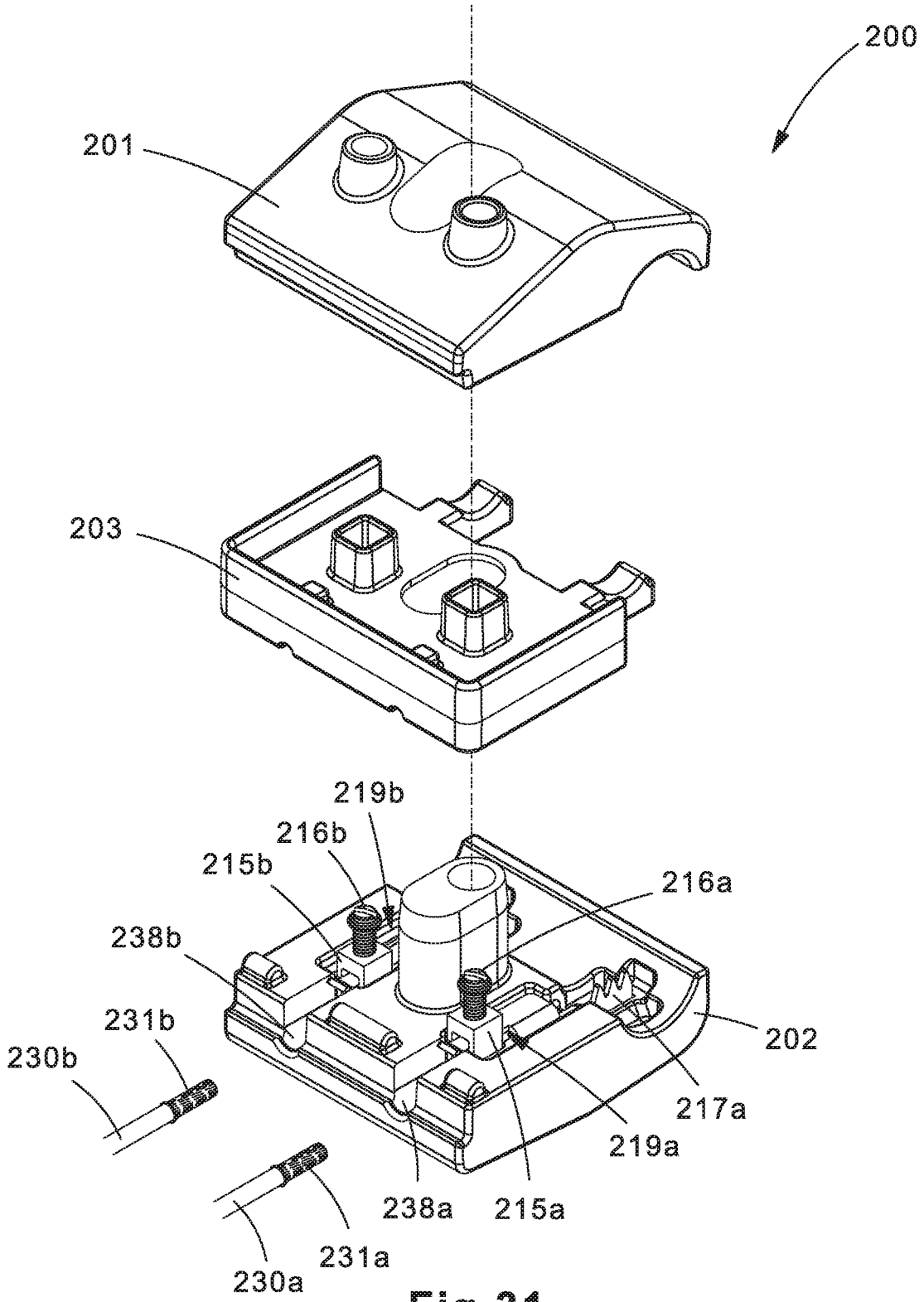
FIG. 31 is an exploded trimetric view of the example insulation piercing connector shown in FIG. 21 along with voltage detection conductors.
Figure 32:
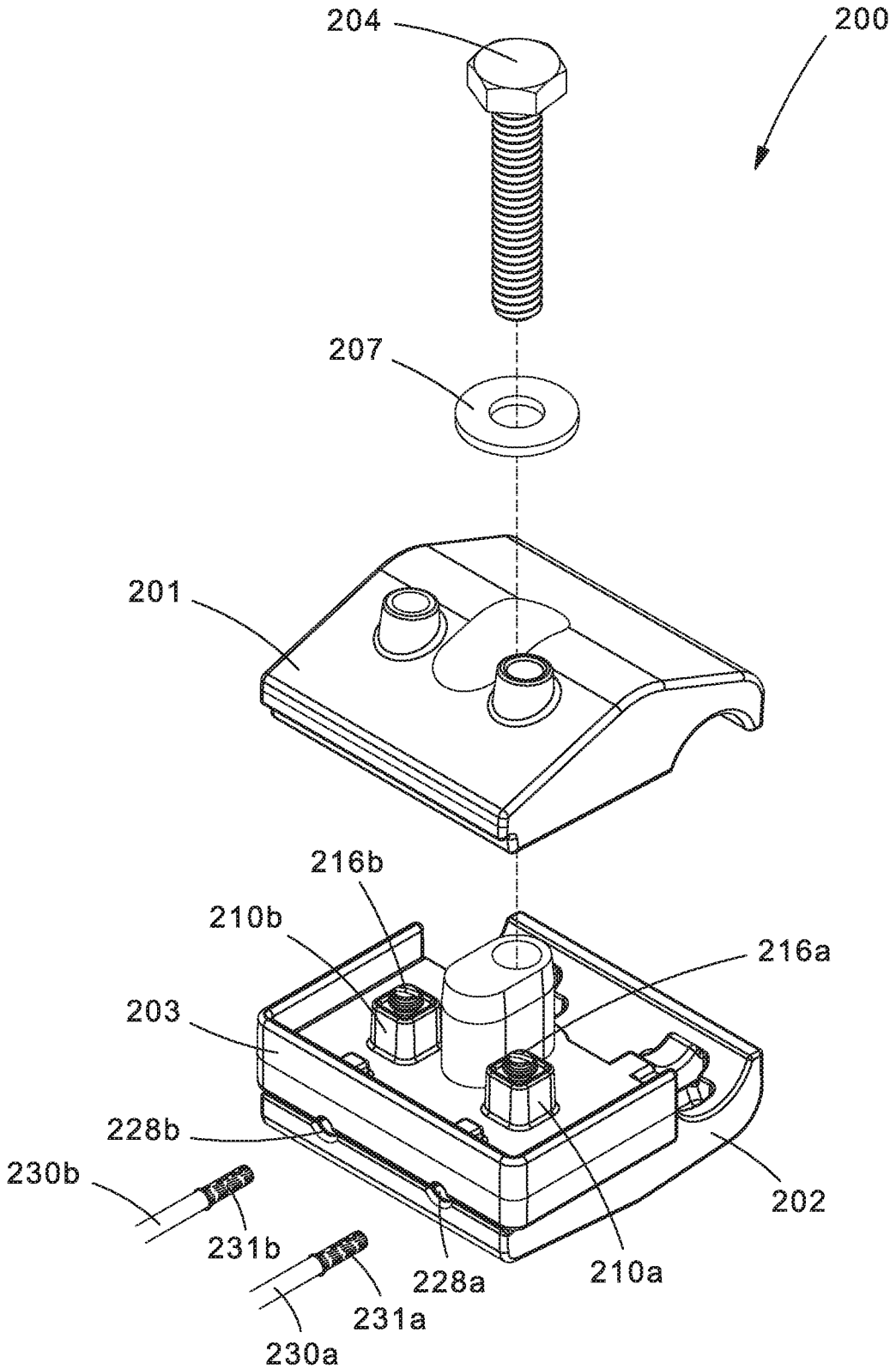
FIG. 32 is an exploded trimetric view of the example insulation piercing connector shown in FIG. 21 along with voltage detection conductors.
Figure 33:
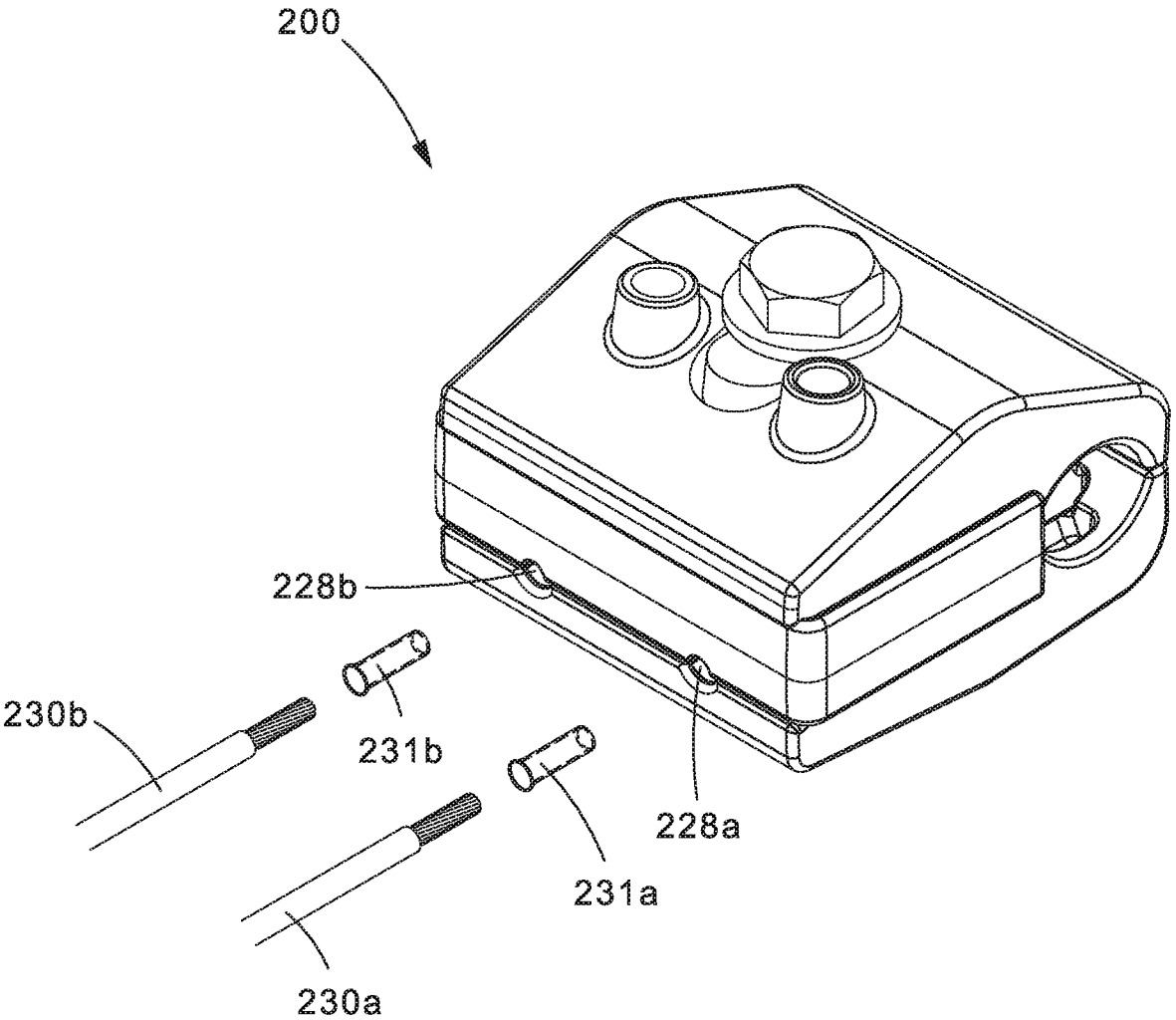
FIG. 33 is a trimetric view of the example insulation piercing connector shown in FIG. 21 along with voltage detection conductors.
Figure 34:
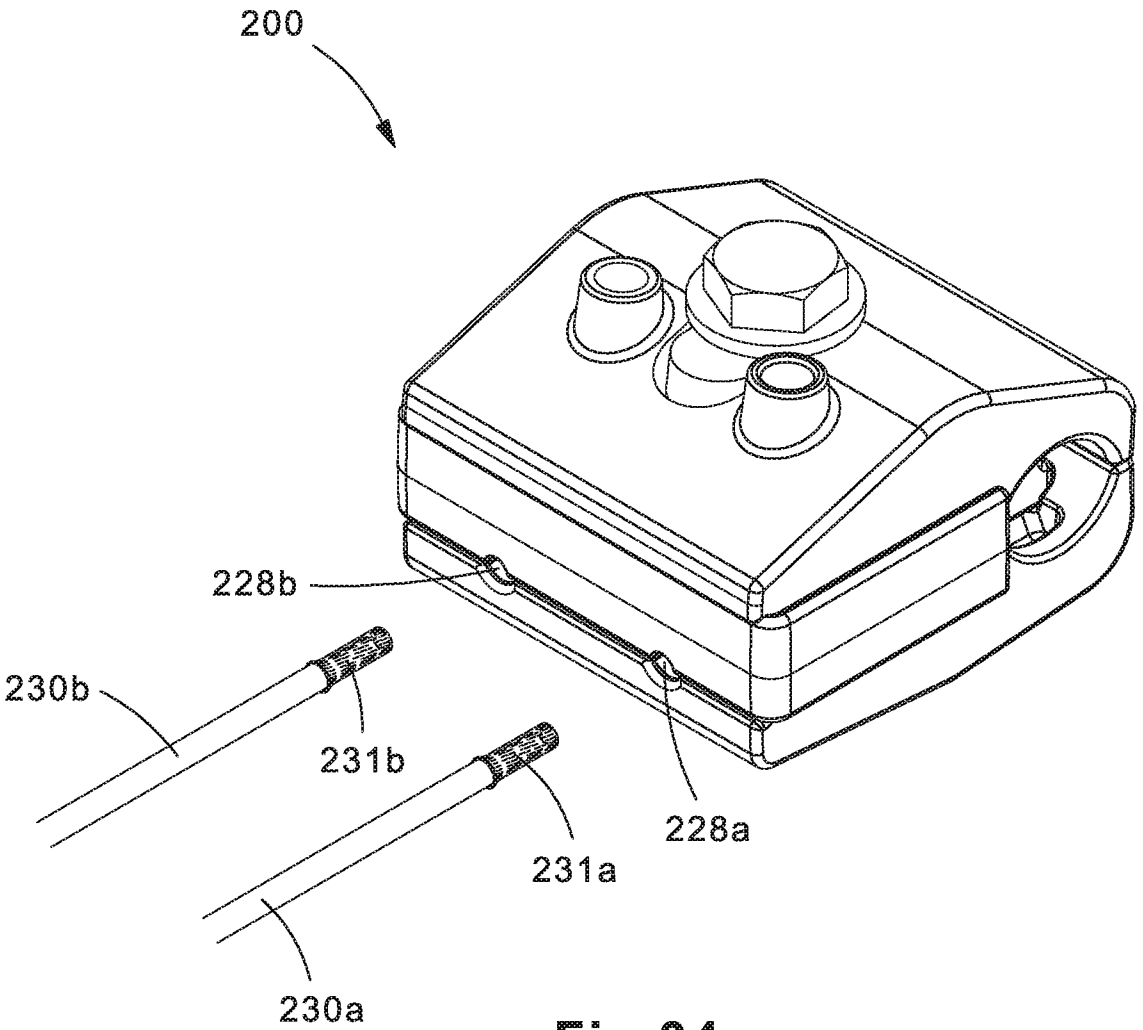
FIG. 34 is a trimetric view of the example insulation piercing connector shown in FIG. 21 along with voltage detection conductors.
Figure 35:
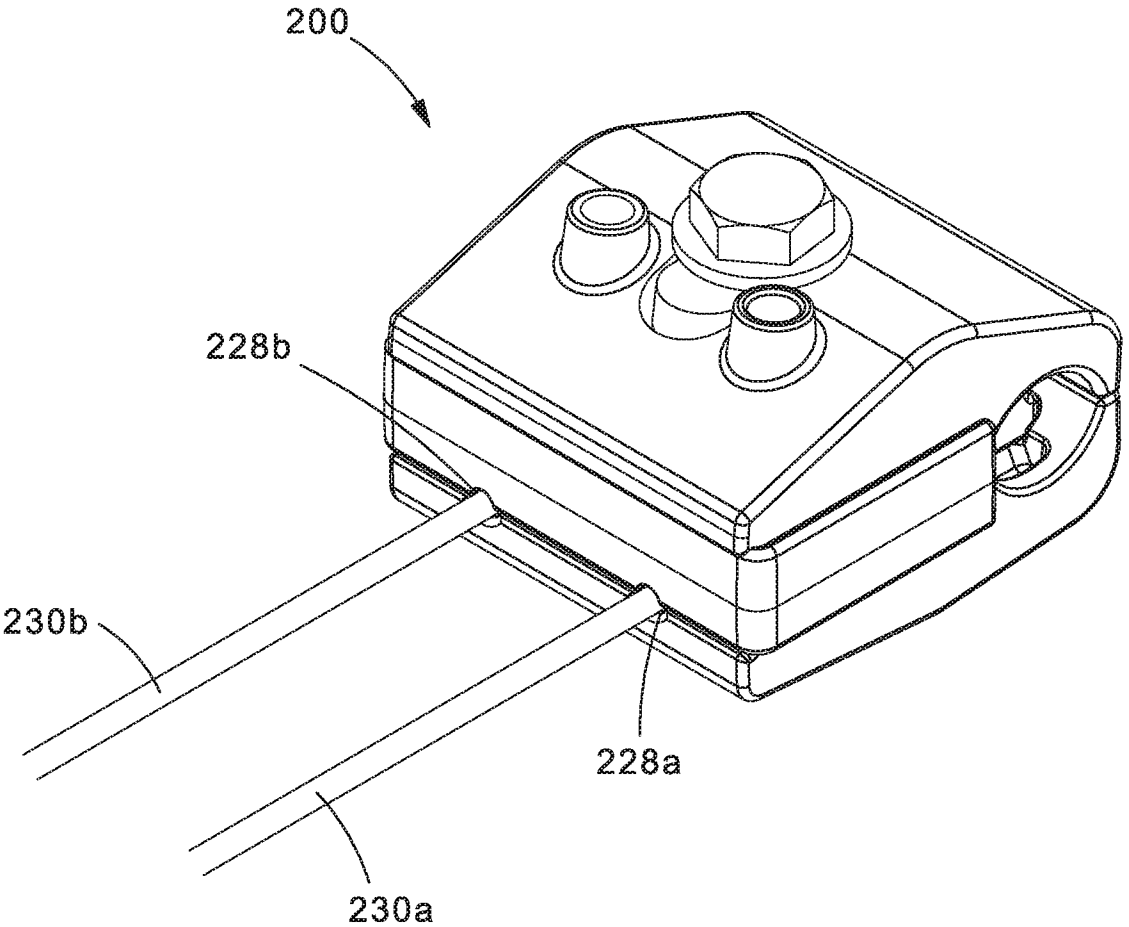
FIG. 35 is a trimetric view of the example insulation piercing connector shown in FIG. 21 attached to voltage detection conductors.
Figure 36:
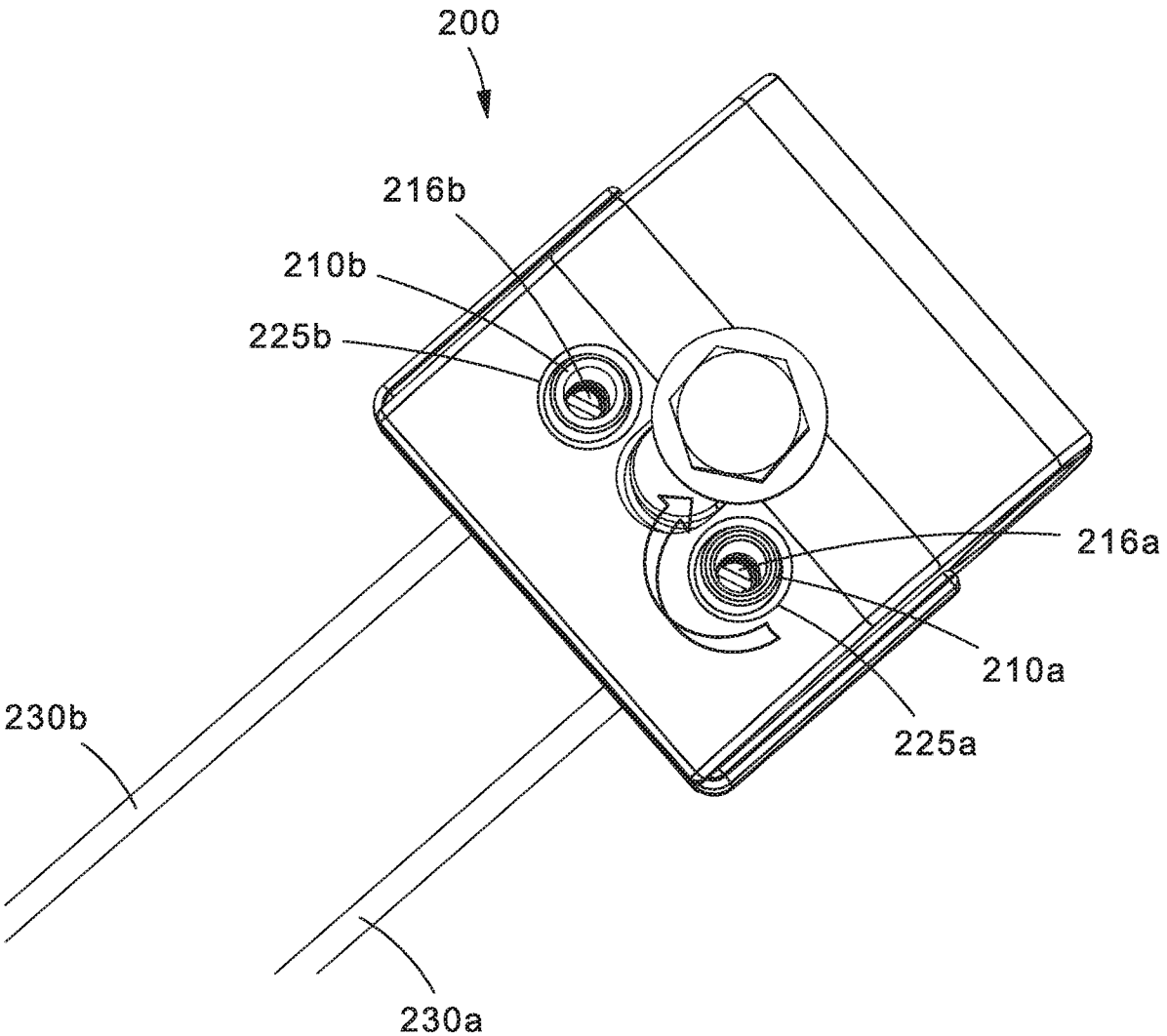
FIG. 36 is a trimetric view of the example insulation piercing connector shown in FIG. 21 attached to voltage detection conductors.
Figure 37:
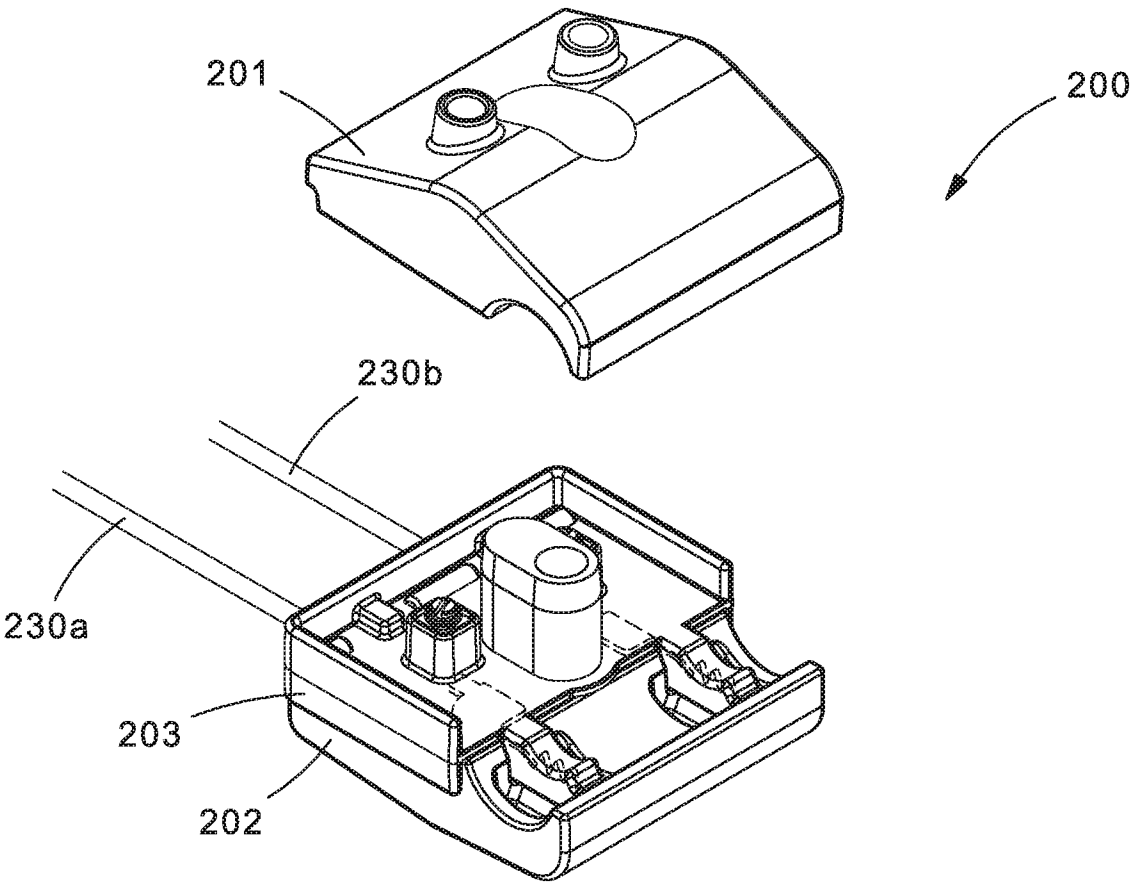
FIG. 37 is an exploded trimetric view of the example insulation piercing connector shown in FIG. 21 attached to voltage detection conductors.
Figure 38:
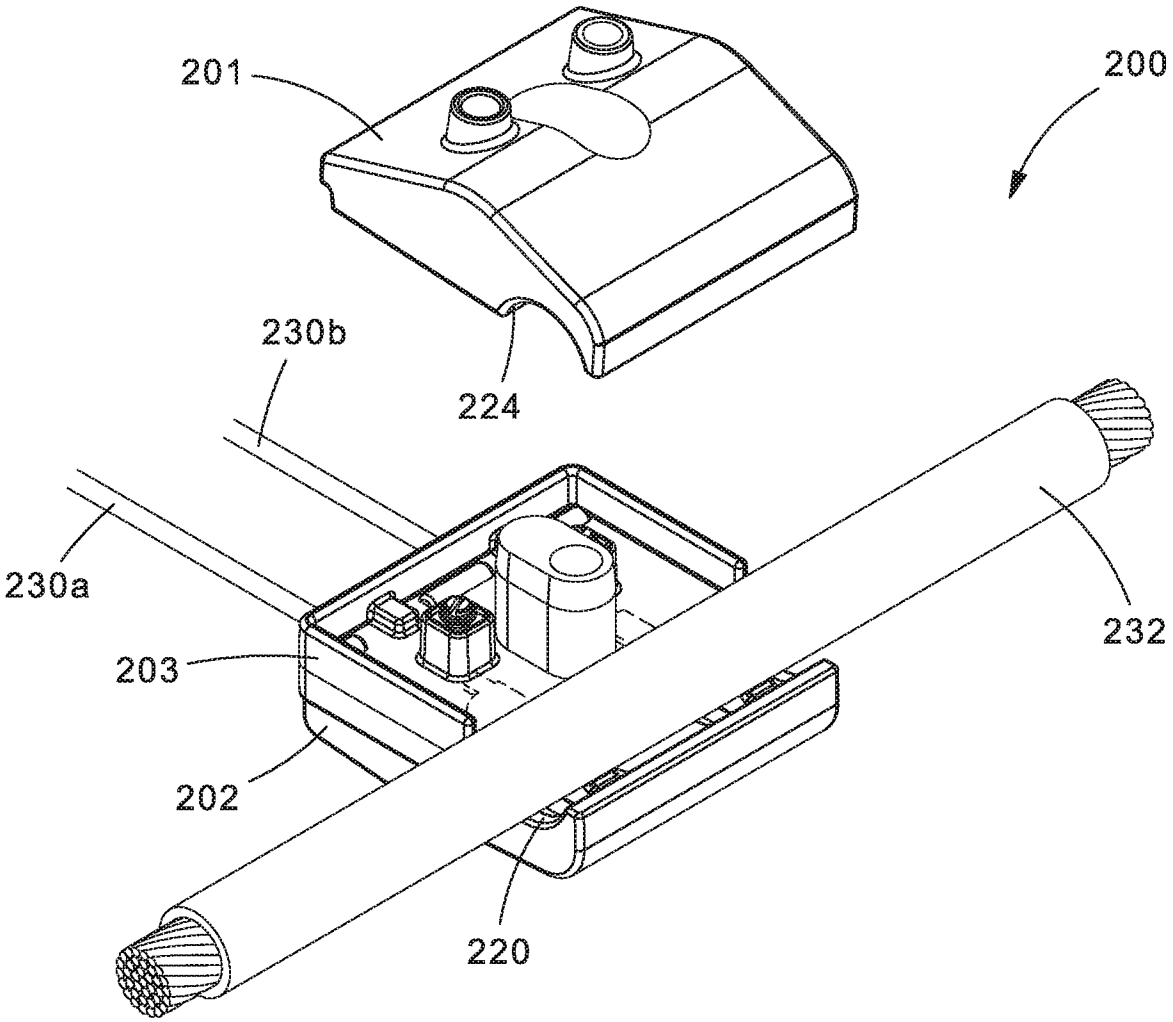
FIG. 38 is an exploded trimetric view of the example insulation piercing connector shown in FIG. 21 attached to voltage detection conductors along with a power cable.
Figure 39A:
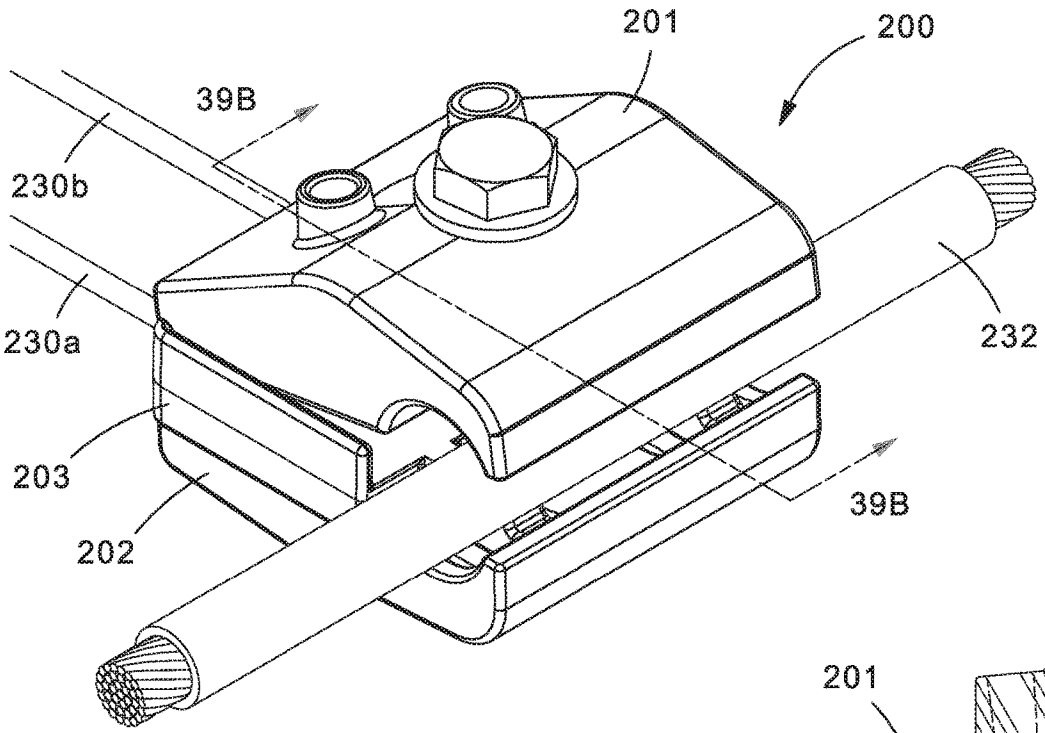
FIG. 39A is a trimetric view of the example insulation piercing connector shown in FIG. 21 attached to voltage detection conductors along with a power cable.
Figure 39B:
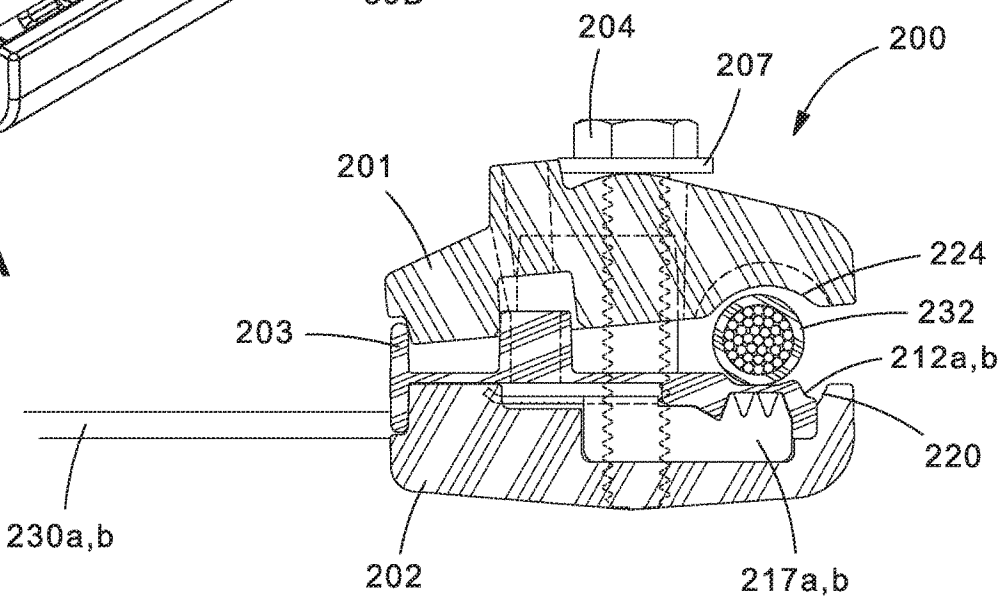
FIG. 39B is a cross-sectional view along line 39B-39B in FIG. 39A of the example insulation piercing connector shown in FIG. 21 attached to voltage detection conductors along with a power cable.
Figure 40A:
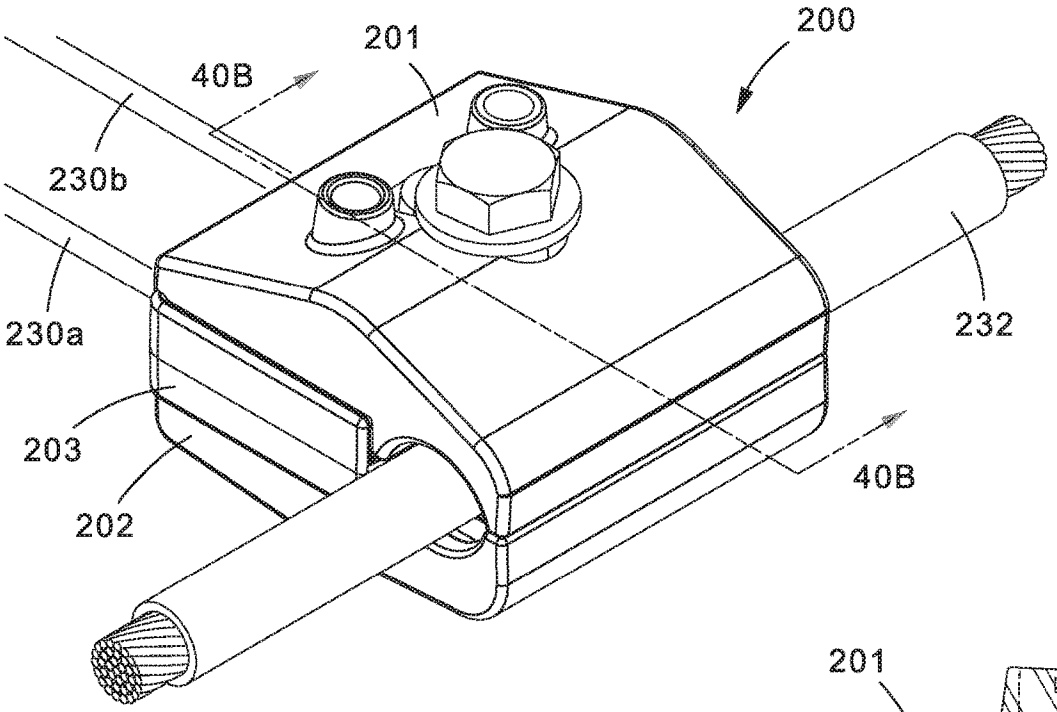
FIG. 40A is a trimetric view of the example insulation piercing connector shown in FIG. 21 attached to voltage detection conductors and a power cable.
Figure 40B:
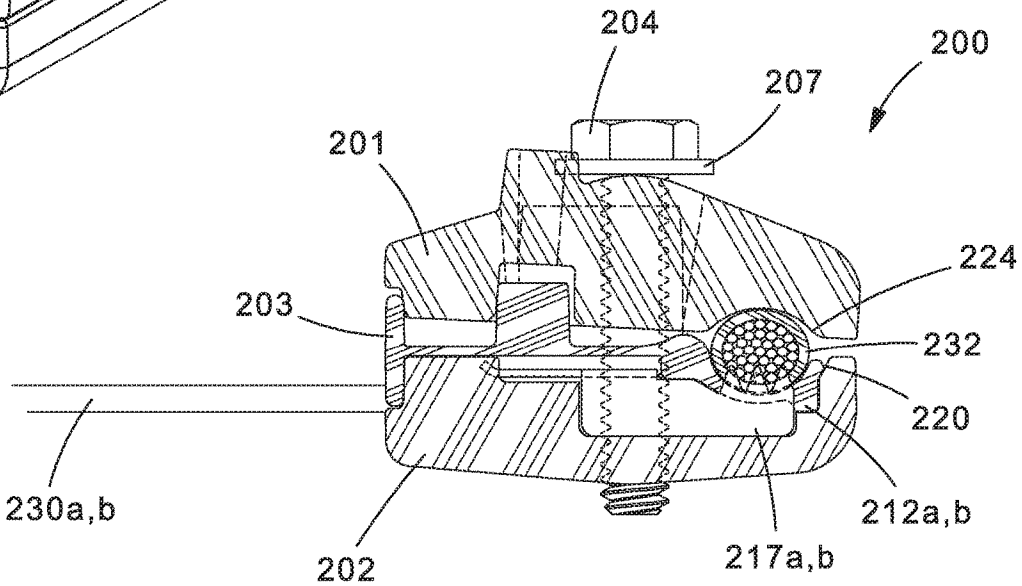
FIG. 40B is a cross-sectional view along line 40B-40B in FIG. 40A of the example insulation piercing connector shown in FIG. 21 attached to voltage detection conductors and a power cable.

FIGS. 21-38, 39A, 39B, 40A, and 40B are illustrations of a second example insulation piercing connector 200. In some implementations, insulation piercing connector 200 may be used to provide a connection between voltage detection conductors 230*a*, 230*b* and a power cable 232 (FIGS. 30-40B). The connection may provide dual independent electrical connections between a voltage detection device (not shown) and power cable 232.

Insulation piercing connector 200 may include a top half 201, a bottom half 202, and a blade seal 203 held together by a fastener 204, such as a screw, bolt, or other types of fasteners. Top half 201, bottom half 202, and blade seal 203 may be made of various insulating materials, such as various types of polymers/plastics. In one example, top half 201, bottom half 202, and blade seal 203 may be made of a glass-filed nylon polymer. Blade seal 203 may be made of a rubber or elastomer. Fastener 204 may be made of an insulating material as well, or may be made of various metals.

A washer 207 (such as a ring washer, spring washer, or other types known in the art) may be positioned between the head of fastener 204 and top half 201 to evenly distribute the compression force applied by fastener 204. The threaded shaft of fastener 204 may be placed through hole 208 in top half 201, hole 211 in blade seal 203, and into a post 214. Post 214 may include a hole having threads therein, where the threads may be formed as integral part of post 214 or may be a metal or plastic threaded insert that is inserted into the hole in post 214. The threads of the threaded shaft of fastener 204 may engage with the threads in the hole in post 214 to compress top half 201, bottom half 202, and blade seal 203 together.

Insulation piercing assembly 233 may provide the electrical connection between power cable 232 and voltage detection conductors 230*a*, 230*b*. Insulation piercing assembly 233 may be made up of components formed of a conductive material such as copper. As shown in the exploded view of insulation piercing assembly 233 in FIG. 2, insulation piercing assembly 233 may include piercing blades 217*a*, 217*b*. The tangs of insulation piercing blades 217*a*, 217*b* may be respectively inserted into holes 229*a*, 229*b* of terminal housings 215*a*, 215*b* along with the ends of voltage detection conductors 230*a*, 230*b*. Voltage detection conductors 230*a*, 230*b* may be positioned underneath the tangs of piercing blades 217*a*, 217*b*. Fasteners (e.g., screws) 216*a*, 216*b* may be tightened to compress the tangs of piercing blades 217*a*, 217*b* and the ends of voltage detection conductors 230*a*, 230*b* against the bottom of terminal housings 215*a*, 215*b* in order to secure piercing blades 217*a*, 217*b* and voltage detection conductors 230*a*, 230*b* in place.

Insulation piercing assembly 233 may be positioned within bottom half 102 of insulation piercing connector 200. For example, insulation piercing assembly 233 may sit in recesses 219*a*, 219*b* of bottom half 202, with the teeth of piercing blades 217*a*, 217*b* respectively sitting in grooves 234*a*, 234*b*. In alternative implementations, insulation piercing assembly 233 may sit in recesses in top half 201.

Blade seal 203 may be positioned on top of bottom half 202 and insulation piercing assembly 233. Blade seal 203 may include a U-shaped sidewall 209 that partially overlaps a portion of top half 201 and bottom half 202. Blade seal 203 may also include notches 223*a-c* that may be positioned in holes 221*a-c* to ensure that blade seal 203 is properly aligned on top of bottom half 202 and insulation piercing assembly 233. Rubberized insulating seals 212*a*, 212*b* may respectively cover the teeth of piercing blades 217*a*, 217*b* prior to insulation piercing connector 200 being compressed around power cable 232, at which point the teeth of piercing blades 217*a*, 217*b* penetrate insulating seals 212*a*, 212*b*. Insulating seals 212*a*, 212*b* prevent voltage leakage from the connection between piercing blades 217*a*, 217*b* and power cable 232 by forming a seal around the portion of the insulating layer penetrated by piercing blades 217*a*, 217*b*. The teeth of piercing blades 217*a*, 217*b* may be positioned respectfully within grooves 227*a*, 227*b* of insulating seals 212*a*, 212*b*.

Top half 201 may be placed on top of blade seal 203. Top half 201 and bottom half 202 may respectively have first round ends 224 and 220. When top half 201, bottom half 202, and blade seal 203 are all assembled, round ends 224 and 220 may form a recess 205 in which power cable 232 may be positioned.

As depicted in FIGS. 39A-40B, in operation, to attach insulation piercing clamp 200 to power cable 232, fastener 204 may be loosened to a point where there is enough space between top half 201 and bottom half 202 to insert power cable 232 into recess 205. Fastener 204 may then be tightened so that a compression force is applied to top half 201 and bottom half 202. The compression force causes the teeth of piercing blades 217*a*, 217*b* to respectively pierce through insulating seals 212*a*, 212*b*, exposing them to the insulation layer around power cable 232. As top half 201 and bottom half 202 compress together further, the teeth of piercing blades 217*a*, 217*b* may pierce through the insulation layer to the core of power cable 232 (which may be solid or stranded), thereby providing dual independent electrical connections to power cable 232. Insulating seals 212*a*, 212*b* prevent voltage leakage at the connection points.

As depicted in FIGS. 33-36, to attach voltage detection conductors 230*a*, 230*b* to terminal housings 215*a*, 215*b*, an installer may insert the conductive ends of voltage detection conductors 230*a*, 230*b* respectively into openings 228*a*, 228*b* of bottom half 202, and into holes 229*a*, 229*b* of terminal housings 215*a*, 215*b* under the tangs of piercing blades 217*a*, 217*b*. Ferrules 231*a*, 231*b* may be installed over the conductive ends of voltage detection conductors 230*a*, 230*b* to provide improved electrical connection with terminal housings 215*a*, 215*b*. The installer may secure voltage detection conductors 230*a*, 230*b* in terminal housings 215*a*, 215*b* by inserting a fastening tool, such as a screw driver through access holes 225*a*, 225*b* in top half 201, and access holes 210*a*, 210*b* in blade seal 203, to tighten fasteners 216*a*, 216*b*.

Note that while the present disclosure includes several embodiments, these embodiments are non-limiting, and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the embodiments of the present disclosure. It is therefore intended that claims that may follow be interpreted as including all such alterations, permutations, and equivalents as fall within the true spirit and scope of the present disclosure.

The invention claimed is:

1. An insulation piercing connector, comprising:

a top half, a bottom half, and a blade seal positioned between the top half and the bottom half; and an insulation piercing assembly including a first fastener, at least one blade, and a terminal housing configured to accept a voltage detection conductor;

wherein the first fastener is configured to act on a tang end of the at least one blade to compress the voltage detection conductor against a bottom of the terminal housing and elevate a teeth end of the at least one blade to extend through the blade seal.

2. The insulation piercing connector of claim 1, wherein the top half includes a first opening and the blade seal includes a second opening, wherein the first and second openings are configured for a second fastener to extend therethrough; and the bottom half includes a third opening configured to accept the second fastener, wherein the second fastener extends through the first opening and second opening and into the third opening to compress the insulation piercing connector.

3. The insulation piercing connector of claim 1, further comprising:

a viewing hole to provide a view of a voltage detection conductor being inserted into a terminal housing of the insulation piercing assembly.

4. The insulation piercing connector of claim 1, wherein the at least one blade is configured to pierce an insulation layer disposed around a power cable.

5. The insulation piercing connector of claim 1, wherein the bottom half and top half each include a concave channel configured to retain a power cable.

6. The insulation piercing connector of claim 1, wherein the blade seal includes an insulating seal portion retained within a recess of the bottom half.

7. The insulation piercing connector of claim 6, wherein a portion of the at least one blade resides within the insulation seal portion.

8. The insulation piercing connector of claim 1, wherein the insulation piercing assembly is configured to provide an electrical connection between a power cable and a voltage detection conductor.

9. The insulation piercing connector of claim 8, wherein the insulation piercing assembly resides within a recess of the bottom half.

10. The insulation piercing connector of claim 1, wherein the top half includes a recess configured to accept an upper portion of the terminal housing.

11. The insulation piercing connector of claim 10, wherein the bottom half includes a recess configured to accept a lower portion of the terminal housing and a portion of the at least one blade.

12. The insulation piercing connector of claim 11, wherein the at least one blade is disposed perpendicularly across a concave portion of the bottom half and configured to extend parallel to the voltage detection conductor, wherein the concave portion is configured to accept a power cable.

13. An insulation piercing connector system, comprising:

a top half, a bottom half, a blade seal positioned between the top half and the bottom half, and a first fastener configured to compress the top half and bottom half together;

an insulation piercing assembly including a second fastener and a blade;

a voltage detection conductor disposed within the bottom half; and a power cable disposed between the top half and bottom half;

wherein the second fastener is configured to elevate a teeth end of the blade to extend through the blade seal and pierce through an insulating seal of the power cable.

14. The insulation piercing connector system of claim 13, wherein the voltage detection conductor is disposed perpendicular to the power cable.

15. An insulation piercing connector comprising:

a top half, a bottom half, a blade seal positioned between the top half and the bottom half, and a first fastener configured to compress the top half and bottom half together;

an insulation piercing assembly including a second fastener, a blade, and a terminal housing, wherein the second fastener is configured to act on a tang end of the blade to compress a voltage detection conductor against a bottom of the terminal housing;

wherein the second fastener is configured to elevate a teeth end of the blade to extend through the blade seal and pierce through an insulating seal of a power cable.

16. The insulation piercing connector of claim 15, wherein the bottom half and top half each include a concave channel configured to retain the power cable.

17. The insulation piercing connector of claim 15, wherein the insulation piercing assembly is configured to provide an electrical connection between the power cable and a voltage detection conductor.

18. The insulation piercing connector of claim 15, wherein the blade is configured to be disposed perpendicularly across the power cable and extend parallel to a voltage detection conductor.

19. The insulation piercing connector of claim 15, wherein the blade seal includes an insulating seal portion retained within a recess of the bottom half.

20. The insulation piercing connector of claim 19, wherein a portion of the at least one blade resides within the insulation seal portion.

* * * * *